US006587765B1

(12) United States Patent
Graham et al.

(10) Patent No.: US 6,587,765 B1
(45) Date of Patent: Jul. 1, 2003

(54) ELECTRONIC CONTROL SYSTEM FOR MARINE VESSELS

(75) Inventors: Dennis I. Graham, Reading, PA (US); Daniel J. Carr, Harleysville, PA (US); Scott L. Kern, Perkasie, PA (US); Howard A. Lang, Dresher, PA (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/874,545

(22) Filed: Jun. 4, 2001

(51) Int. Cl.[7] ..... B60L 3/00
(52) U.S. Cl. ..... 701/21; 701/36; 440/84
(58) Field of Search ..... 701/21, 36; 440/84; 477/112; 74/471 R, 473.3

(56) References Cited

U.S. PATENT DOCUMENTS 4,836,809 A * 6/1989 Pelligrino ..... 440/2
4,898,045 A * 2/1990 Baba ..... 74/471
6,273,771 B1 * 8/2001 Buckley et al. ..... 440/84

OTHER PUBLICATIONS

Barron, J., "Propulsion, Get on the Bus," *Trailer Boats Magazine*, Jun. 2000, p. 36.

*Boating Magazine*, "Know it by Chart," May 2000, p. 100.

*Boating Industry International*, "Gains in technology will alter makeup of the [title test missing]; New standard being developed for electronic equipment installation; Technicians' revenue may be hurt by advancements in system technology," Nov. 2000, 41–47.

Declaration Pursuant to 37 C.F.R. § 1.56 executed and dated May 15, 2000 with attached Exhibit A, 29 pages.

Denn, J., "Future boat sales will hinge on technology," *Boating Industry International*, Nov. 2000, p. 40.

Hemmel, J., "Information, Please, The digital boating revolution begins," *Boating Magazine*, Sep. 2000, 1 page.

Kelly, C., "Electronics—Can We Talk?," *Power & Motoryact*, Jun. 2000, 36–37.

*Motorboating*, "Plug and Play," Dec. 2000, p. 57.

Teleflex Corporation, "The New Standard in Control & Information Systems," *MagicBus*™, Brochure No date.

* cited by examiner

*Primary Examiner*—Yonel Beaulieu
(74) *Attorney, Agent, or Firm*—Woodcock Washburn LLP

(57) ABSTRACT

A control system for a marine vessel having one or more engines and a transmission associated with each engine includes one or more control stations, each having a control arm. The system includes one or more electronic control units, each of which is electro-mechanically coupled to an engine and a transmission. A first electronic control unit (ECU) controls a throttle of a first engine and a shift position of a first transmission based on the electrical signal. The second ECU is coupled to the first ECU via the communications link, and controls the throttle of a second engine and the shift position of a second transmission based on a control signal from the first ECU.

40 Claims, 13 Drawing Sheets

| LEVER POSITION | THROTTLE | SHIFT POSITION | V | COUNTS | PERCENT OF RANGE |
|---|---|---|---|---|---|
| 0 | FULL | R | 0.22 | 56 | 100 |
| 42.5 | IDLE | R | 1.18 | 295 | 0 |
| 57.5 | IDLE | N | 1.52 | 380 | 0 |
| 72.5 | IDLE | F | 1.84 | 460 | 0 |
| 160 | FULL | F | 3.69 | 920 | 100 |

FIG. 7

ELECTRONIC CONTROL SYSTEM FOR MARINE VESSELS

FIELD OF THE INVENTION

This invention relates to control systems for marine vessels. More particularly, the invention relates to electronic control systems for marine vessels having a plurality of engines and/or a plurality of control stations.

BACKGROUND OF THE INVENTION

Marine vessels often include a plurality of engines, such as a port engine and a starboard engine, for example. Such vessels also include a transmission associated with each engine (i.e., a port transmission and starboard transmission). An engine/transmission pair is commonly known as a "power train." Such vessels typically include a plurality of control mechanisms, such as control arms or levers, via which an operator of the vessel can control the several power trains. It is common for a separate control arm to be provided for each power train. Thus, the operator of such a vessel can control the throttle of a selected engine and the shift position of the transmission associated with that engine via an associated control mechanism.

Under certain circumstances, an operator might wish to control each of a plurality of power trains individually (so that the operator can quickly turn the vessel about, for example). Under other circumstances, however, the operator might wish to synchronize control of the power trains, that is, to keep both engines at the same throttle and both transmissions at the same shift position.

To accomplish this synchronized control, the operator is often forced to try to synchronize the control mechanisms manually, that is, to try to keep both control levers in the same location relative to one another with the expectation that the engines and transmissions will, therefore, be synchronized. As this approach is cumbersome and inherently inaccurate, systems and methods have been developed previously to enable an operator to control the throttle of a plurality of engines using a single lever. Such systems typically couple a single, master control lever to a plurality of engines, so that when the operator varies the position of the master control lever, the throttle of each of the plurality of engines varies accordingly.

Such systems usually do not also provide synchronized control of the transmissions, however, and usually disengage when the operator returns the control lever to the neutral position. Additionally, the inventors know of no system whereby a operator of a marine vessel can control both throttle and shift position for each of a plurality of power trains from a single control lever. It would be advantageous to operators and manufacturers of marine vessels, therefore, if there were provided systems and methods for controlling a plurality of power trains via a single control lever.

It is well known that engine parts and other parts of a marine vessel's control system wear due to ordinary use or misuse. It is also well known that, as these parts wear out, the responsiveness and sensitivity of the system degrades such that, over time, the operator will sense a change in system performance. To minimize the effects of such degradation, it would be advantageous to operators of such systems if the systems were automatically tune, in a manner transparent to the operator, so that the changes in system performance due to degradation of system components would be less noticeable.

Though some marine vessels have more than one control station, only one control station can control the operation of the vessel at any given time. Therefore, such vessels typically provide a capability that enables the operator of the vessel to transfer control from one station to another. Sometimes, however, the control transfer process can be initiated without the operator's knowledge or consent. For example, children playing with a control station that is not currently in control of the vessel might inadvertently transfer control to that control station without the operator's knowledge. Obviously, such an unauthorized transfer of control could be dangerous. It would be advantageous, therefore, if systems and methods were provided to prevent such unauthorized transfers of control between control stations.

A control lever typically permits a range of throttle from full forward, through neutral, to full reverse. As the operator moves the control lever through its operational range, the throttle varies accordingly. Sometimes, however, such as when the operator is docking the vessel, the operator would like more sensitivity from the control handle. That is, the operator would like to be able to move the control lever a greater distance without increasing the throttle. Moreover, different operators prefer different sensitivities under such circumstances. It would be advantageous, therefore, if systems and methods were provided whereby an operator could dynamically program the vessel's control system so that the control lever's operating range could be varied from a first range of throttle to a second, user-defined range of throttle for the same operating range of the control lever.

Typically, a marine vessel includes the capability for the operator to throttle the engine at a predefined forward idle speed and a reverse idle speed (generically, a gear idle speed). That is, for each of the one or more engines that the vessel includes, the throttle is set to a predefined throttle value whenever the control handle is moved into a predefined gear idle position. Under certain circumstances, however, an operator might wish to vary the gear throttle speed, that is, to operate the vessel at an alternate gear idle throttle speed. Moreover, different operators might wish to use different alternate gear throttle speeds. It would be advantageous, therefore, if systems and methods were provided that enable an operator to program alternate, user-selectable gear idle throttle values.

SUMMARY OF THE INVENTION

The present invention satisfies these needs in the art by providing electronic control systems for marine vessels having one or more engines, and a transmission associated with each engine. A control system according to the invention can include a control arm and arm position means for providing an electrical signal that represents a position of the control arm within its operating range.

The system includes one or more electronic control units (ECUs). Each ECU is electro-mechanically coupled to an engine and transmission. Each ECU is coupled to a communications link, via which the ECUs can pass messages to one another. Tachometric data is passed directly from the engine to the ECU.

According to an aspect of the invention, an operator can vary the neutral idle rate from the manufacturer-provided default by entering a "neutral idle warmup" mode. To enter neutral idle warmup mode, the operator moves the control arm into a neutral position, and inputs a neutral command to the control system via a command input device. The control system then enters neutral throttle warmup mode. Thereafter, the control lever can be used to vary the idle throttle rate (i.e., increase or decrease the throttle of the associated engine without engaging the associated transmission).

According to another aspect of the invention, the operator can initiate transfer of control from one control station to another regardless of the current throttle rate or shift position. To initiate a station transfer, the operator enters a select command at the station to which control is to be transferred (the transferee station). Then, if, within a certain amount of time, the operator matches (approximately) the lever position at the transferee station to the position of the control lever at the transferring station, transfer of control occurs. According to this aspect of the invention, the control system can be configured to require the operator to enter a station protect sequence in order to transfer control from the transferring station to the transferee station. In station protect mode, the operator is required to enter a sequence of commands from the transferee station, and to match the control levers at the transferee station to within a predefined tolerance of the lever positions at the transferring station within a short timeout period after the sequence is entered.

Typically, the default idle throttle rates are set by the engine's manufacturer. According to another aspect of the invention, an operator can change the idle throttle rate from the default rate to an alternate, user-provided idle throttle rate.

Accordingly, the ECU is programmable, and includes an operator interface via which the operator can specify either or both of an alternate forward idle throttle value and an alternate forward idle throttle value. The alternate gear idle throttle rates are expressed as a percentage of the default idle throttle. To change the idle throttle from the default value to the user-specified value, the operator moves the control handle into a gear idle position and then inputs a neutral command via a command input device. In alternate idle throttle mode, the ECU sets the idle throttle to the user specified percentage of throttle, rather than to the default idle throttle. While the system is in alternate idle throttle mode, the ECU will disregard any movement of the control handle within the gear.

The sensitivity of the control handle is a function of the engine throttle range that corresponds to the forward throttle operating range of the control arm. According to another aspect of the invention, to increase the sensitivity of the control arm, the control system enables the operator to select an alternate range of throttle that is less than the default range. In alternate throttle mode, the operator is required to move the control arm a greater distance along its operational range to change engine throttle the same amount as in ordinary throttle mode. Thus, the sensitivity of the control arm can be increased, thereby providing the operator with more control over changes in throttle.

According to another aspect of the invention, the control system enables the operator to control a plurality of power trains (i.e., engine/transmission pairs) using a single control lever. Preferably, the control system enables the operator to control both port and starboard power trains via a single, master control lever. Thus, in contrast to known systems, a control system according to the invention provides for synchronized control of a plurality of engines in forward, neutral, and reverse.

To control the positions of the plurality of throttle actuator rods, a control system according to the invention preferably includes a multi-stage engine synchronization algorithm designed to provide the slave engine with smooth responses to changes in the master engine's throttle. In a first stage of the multi-stage engine synchronization algorithm, lever synchronization, the system provides the slave engine with a throttle value based on the percent throttle of the master engine. That is, the master ECU determines the current percent of throttle based on the current position of the master control arm. The master ECU communicates its current percent of throttle to the slave ECU, which, in turn, commands the slave engine to achieve the same percent of throttle. In a second stage of synchronization, tach sync, a fine adjustment is made to engine throttle by comparing tachometric data from the engines. When the master and slave engines are within a predefined rate tolerance engine sync is considered to be complete.

It is well known that the amount of force an actuator needs to move its associated actuator rod from a first position to a second position varies from vessel to vessel, and even from engine to engine. According to another aspect of the invention, the control system includes a dynamic calibration or tuning capability so that the manufacturer and installer need not calibrate the system manually for each installation.

The ECU varies the amount of power it provides to the actuator's motor based on historical data it maintains about the amount of power the actuator needs to move its actuator rod a certain distance in a certain amount of time. The ECU calculates the current needed to drive the actuator's motor using the well known proportional integral derivative (PID) parameters, which provide a standard way to control the actuator servo. The ECU has a priori knowledge of how long the actuator should be expected to take to move the rod a certain distance.

While the actuator is moving the rod into place, the dynamic tuning process monitors how quickly the rod is actually moving. If the process determines that more or less force is necessary to move the rod into position in the expected amount of time, then the processor causes the actuator to apply more or less power to achieve the target. Each time the ECU controls the position of an actuator rod, it updates the parameters in a dynamic tuning table. The next time it needs to move the rod, it retrieves the data from the table and uses the data to calculate current for the next move. In this way, as system components degrade, the ECU automatically adjusts the amount of power it uses to move the rod.

BRIEF DESCRIPTION OF THE DRAWINGS

The foregoing summary, as well as the following detailed description of the preferred embodiments, is better understood when read in conjunction with the appended drawing. For the purpose of illustrating the invention, there is shown in the drawing an embodiment that is presently preferred, it being understood, however, that the invention is not limited to the specific methods and instrumentalities disclosed.

FIG. 7 depicts a lever position conversion table for use in accordance with the invention.

DETAILED DESCRIPTION OF THE PREFERRED EMBODIMENTS

Control System Overview

Figure 1:
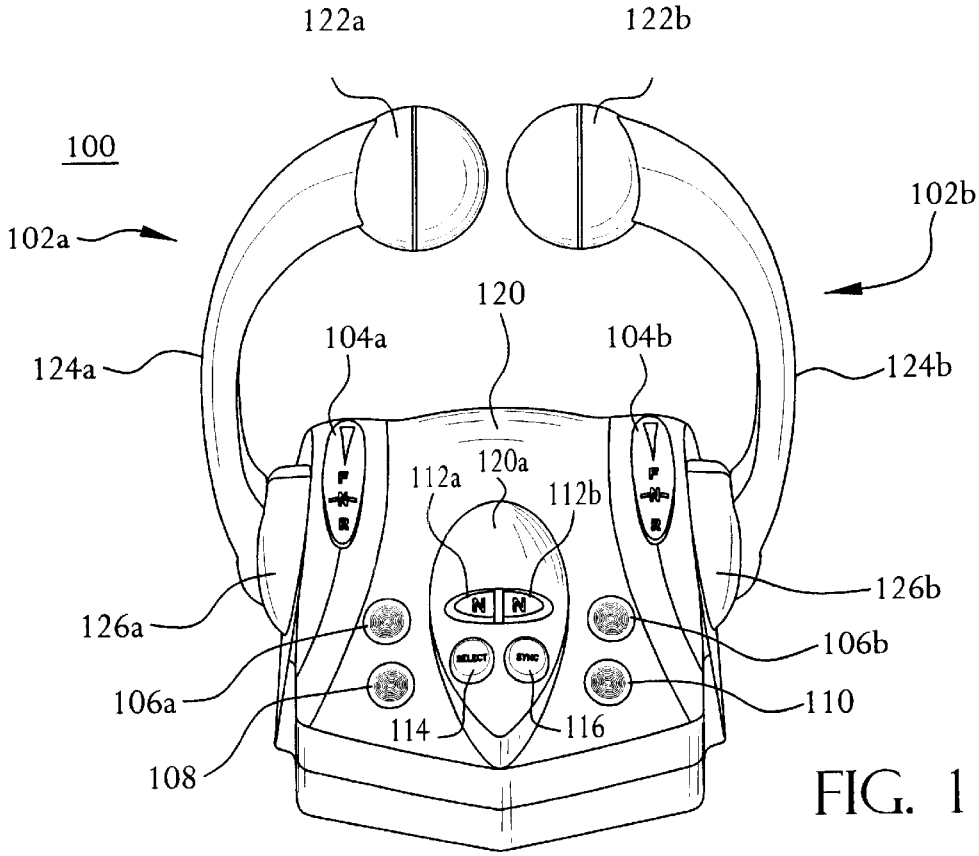
FIG. 1 depicts a preferred embodiment of a control head for use in accordance with the invention.

FIG. 1 depicts a preferred embodiment of a dual, top-mount control head 100 for controlling a marine vessel having a plurality of engines. The control head 100 includes a housing 120, a first (or port) engine control lever 102*a*, and a second (or starboard) engine control lever 102*b*. Though the control head 100 is described herein with respect to a port engine and a starboard engine, it should be understood that the control head can be adapted to control any number of engines, and that the engines need not necessarily be port or starboard engines per se.

The port control lever 102*a* controls the throttle of the port engine (not shown) and the shift position of the port transmission (not shown). The port control lever 102*a* can be rotationally coupled to the housing 120, via a port control lever rotational coupling mechanism 126*a*, and can include a port control lever knob 122*a* and a port control lever handle 124*a*. Similarly, the starboard control lever 102*b* controls the throttle of the starboard engine (not shown) and the shift position of the starboard transmission (not shown). The starboard control lever 102*b* can be rotationally coupled to the housing 120, via a starboard control lever rotational coupling mechanism 126*b*, and can include a starboard control lever knob 122*b* and a starboard control lever handle 124*b*. The starboard control lever 102*b* is rotationally coupled to the housing 120 via a starboard control lever rotational coupling mechanism 126*b*.

The control head 100 also includes a port engine shift status indicator 104*a*, and a starboard engine shift status indicator 104*b*. Each shift status indicator 104*a*, 104*b* indicates, based on the current position of the corresponding control lever 102*a*, 102*b*, the current shift position (i.e., forward, neutral, or reverse) of the corresponding transmission, and the current throttle (i.e., from full reverse to full forward) of the corresponding engine. Each control lever 102 can be moved through an operational range from full reverse throttle to full forward throttle (see FIG. 5). Thus, by moving a control lever 102 along its operational range, an operator can control both the shift position of the corresponding transmission and the throttle of the corresponding engine simultaneously. Preferably, the operational range of the control lever 102 is 160 degrees.

In a preferred embodiment, the control head 100 also includes a port engine neutral indicator 106*a*, a starboard engine neutral indicator 106*b*, a control head indicator 108, and an engine sync indicator 110. Preferably, the indicators 106*a*, 106*b*, 108, and 110 are light emitting diodes (LEDs). More preferably, the engine neutral indicators 106*a*, 106*b* are amber LEDs, the control head indicator 108 is a green LED, and the engine sync indicator 110 is a blue LED. The purpose and functions of the indicators 106*a*, 106*b*, 108, and 110 are described in detail below.

The control head 100 can also include a port neutral command input device 112*a*, a starboard neutral command input device 112*b*, a select command input device 114, and a sync command input device 116. Preferably, the input devices 112*a*, 112*b*, 114, and 116 are buttons, which can be disposed on a face 120*a* of the housing 120 and arranged in the form of a keypad. The purpose and functions of the input devices 112*a*, 112*b*, 114, and 116 are described in detail below.

Figure 2:
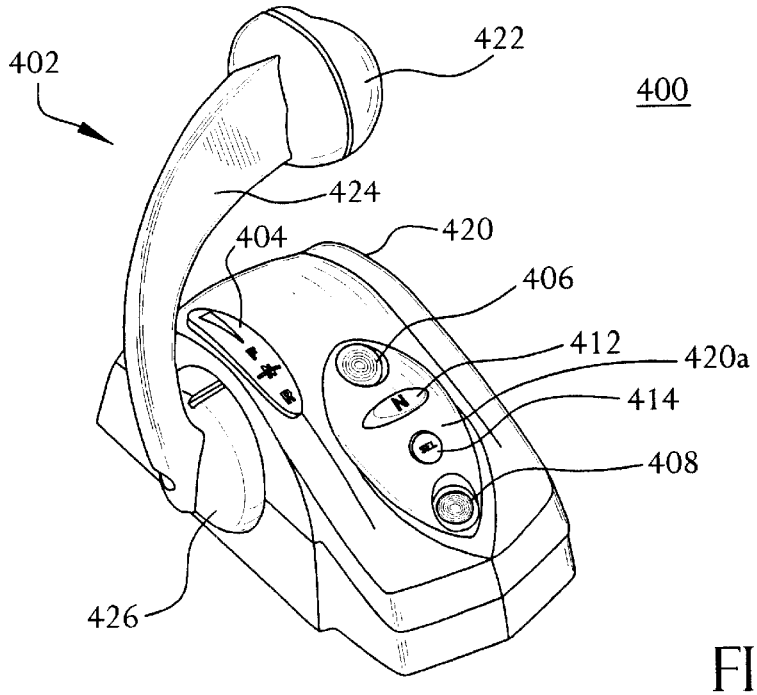
FIG. 2 depicts an alternative embodiment of a control head for use in accordance with the invention.

FIG. 2 depicts a preferred embodiment of a single top mount control head 400 for controlling a boat having one or more engines. The control head 400 includes a housing 420 and an engine control lever 402. The control lever 402 controls the throttle of an associated engine (not shown) and the shift position of an associated transmission (not shown). The control lever 402 can be rotationally coupled to the housing 420, via a control lever rotational coupling mechanism 426, and can include a control lever knob 422 and a control lever handle 424.

Preferably, the control head 400 also includes an engine shift status indicator 404 that indicates the current engine throttle and transmission shift position based on the current position of the control lever 402. The control lever 402 can be moved through an operational range, of 180 degrees preferably, from full reverse throttle to full forward throttle. Thus, by moving the control lever 402 along its operational range, an operator can control both the shift position of the transmission and the throttle of the engine simultaneously.

In a preferred embodiment, the control head 400 also includes an engine neutral indicator 406 and a control head indicator 408. Preferably, the engine neutral indicator 406 is an amber LED, and the control head indicator 408 is a green LED. The purpose and functions of the indicators 406, 408 are described in detail below.

The control head 400 can also include a neutral command input device 412, and a select command input device 414. Preferably, the input devices 412 and 414 are buttons, which can be disposed on a face 420*a* of the housing 420 and arranged in the form of a keypad. The purpose and functions of the input devices are described in detail below.

Figure 3:
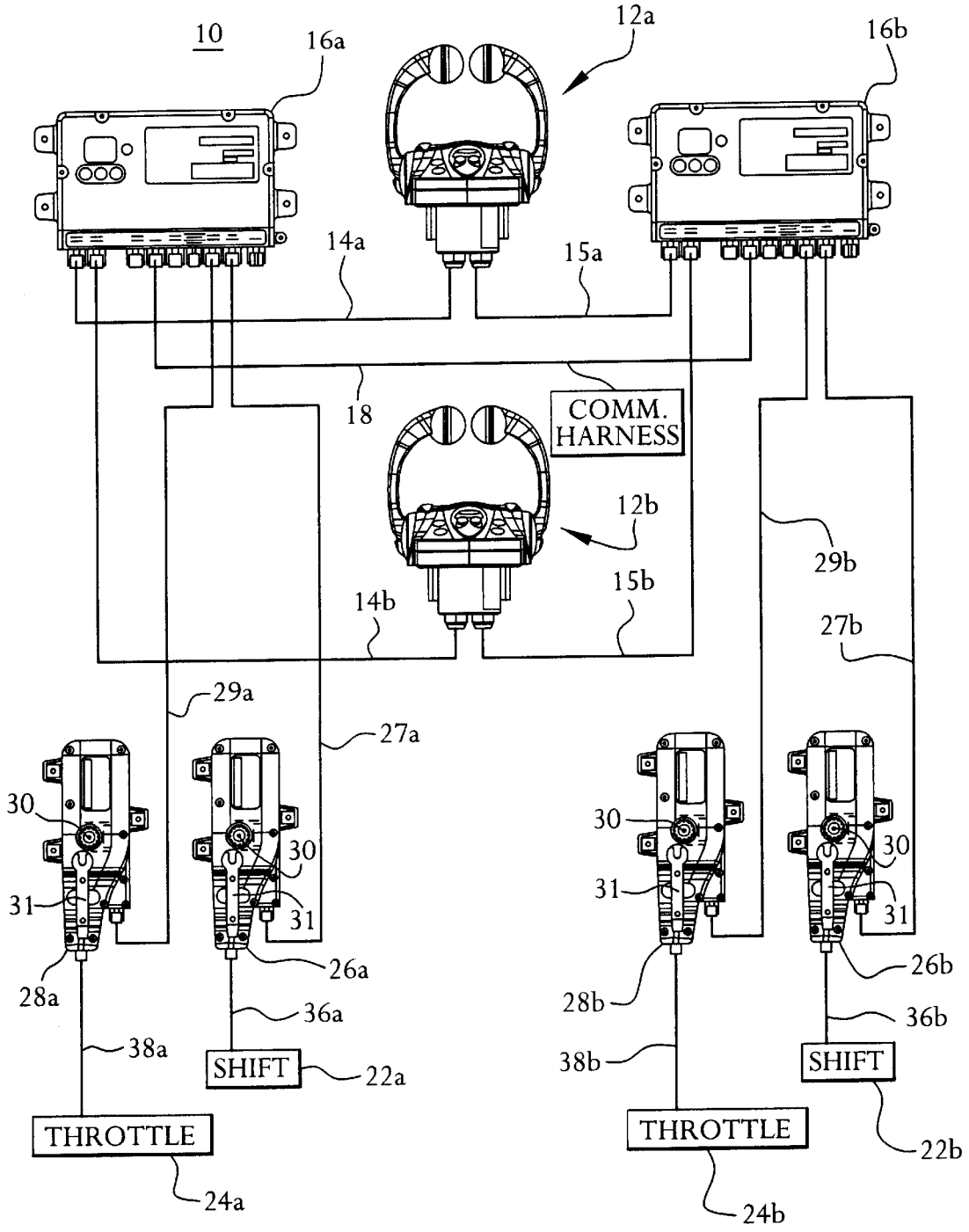
FIG. 3 depicts a preferred embodiment of a control system according to the invention.

FIG. 3 depicts a preferred embodiment of a control system 10 according to the invention. As shown, the control system 10 can include one or more control heads 12. Each control head 12 can be, for example, any of the control heads described above in connection with FIGS. 1 and 2. Though the control system 10 depicted in FIG. 3 includes two control heads 12*a* and 12*b*, it should be understood that a control system according to the invention can include any number or type of control heads 12.

As shown, each control head 12*a*, 12*b* includes two control levers. Each control head 12*a*, 12*b* is electrically coupled to one or more electronic control units (ECUs) 16*a*, 16*b*. Preferably, the control heads 12*a*, 12*b* are coupled to the ECUs 16*a*, 16*b* via one or more cables 14*a*, 14*b*, 15*a*, 15*b*. The cables 14, 15 contain wires (not shown) that carry electrical signals from the control head 12 to the ECU 16.

The ECUs 16*a*, 16*b* are communicatively coupled to one another via a communications link, or harness, 18. Preferably, the communications link 18 is a standard network connection, such as the well-known CANBus. The ECUs 16*a*, 16*b* can pass messages to one another via the communications link 18 using a predefined protocol, such as the well-known NMEA 2000 protocol. Though CANBus and NMEA 2000 are provided by way of example, it should be understood that the communications link 18 can be any suitable communications link and can employ any suitable communications protocol.

Each ECU 16*a*, 16*b* is electrically connected to a corresponding shift actuator 26*a*, 26*b* via a respective electrical path 27*a*, 27*b*, and to a corresponding throttle actuator 28*a*, 28*b* via a respective electrical path 29*a*, 29*b*. Preferably, each of the electrical paths 27, 29 comprises a cable that contains a pair of conductive leads that provide actuator drive current from a power supply in the ECU 16 to a direct current (DC) motor in the actuator 26, 28, and an electrical conductor that carries actuator rod position feedback signals to the ECU 16 from a rod position sensor in the actuator 26, 28. The transfer of electrical information between the ECU 16 and the actuators 26, 28 is described in greater detail below.

Each shift actuator 26*a*, 26*b* is electro-mechanically coupled, via a shift actuator rod 36*a*, 36*b*, to a corresponding transmission 22*a*, 22*b*. As will be described in detail below, each shift actuator 26*a*, 26*b* actuates the shift position of the corresponding transmission 22*a*, 22*b* by moving the actuator rod 36*a*, 36*b* into one of a number of predefined positions. Similarly, each throttle actuator 28*a*, 28*b* is electro-mechanically coupled, via a throttle actuator rod 38*a*, 38*b* to a corresponding engine 24*a*, 24*b*. Each throttle actuator 26*a*, 26*b* actuates the throttle of the corresponding engine 24*a*, 24*b* by moving the actuator rod 38*a*, 38*b* into one of a number of predefined positions. Thus, each control head 12*a*, 12*b* can be operatively coupled to each of a plurality of transmissions 22*a*, 22*b* and engines 24*a*, 24*b*.

Preferably, each actuator 26, 28 includes a manual means of operation as a safety feature. As shown, each actuator 26, 28 includes a manual operation handle 30, and a wrench 31 that is removably coupled to the actuator housing. In the event of loss of system power or motor failure with the actuator, the wrench can be used to operate the manual operation handle to adjust the position of the actuator rod, without disengaging the push/pull cable that operates the throttle and shift position. Such a design feature prevents any attempt to manually drive the system while in automatic mode, thereby preventing any potential system damage by the operator.

Figure 4:
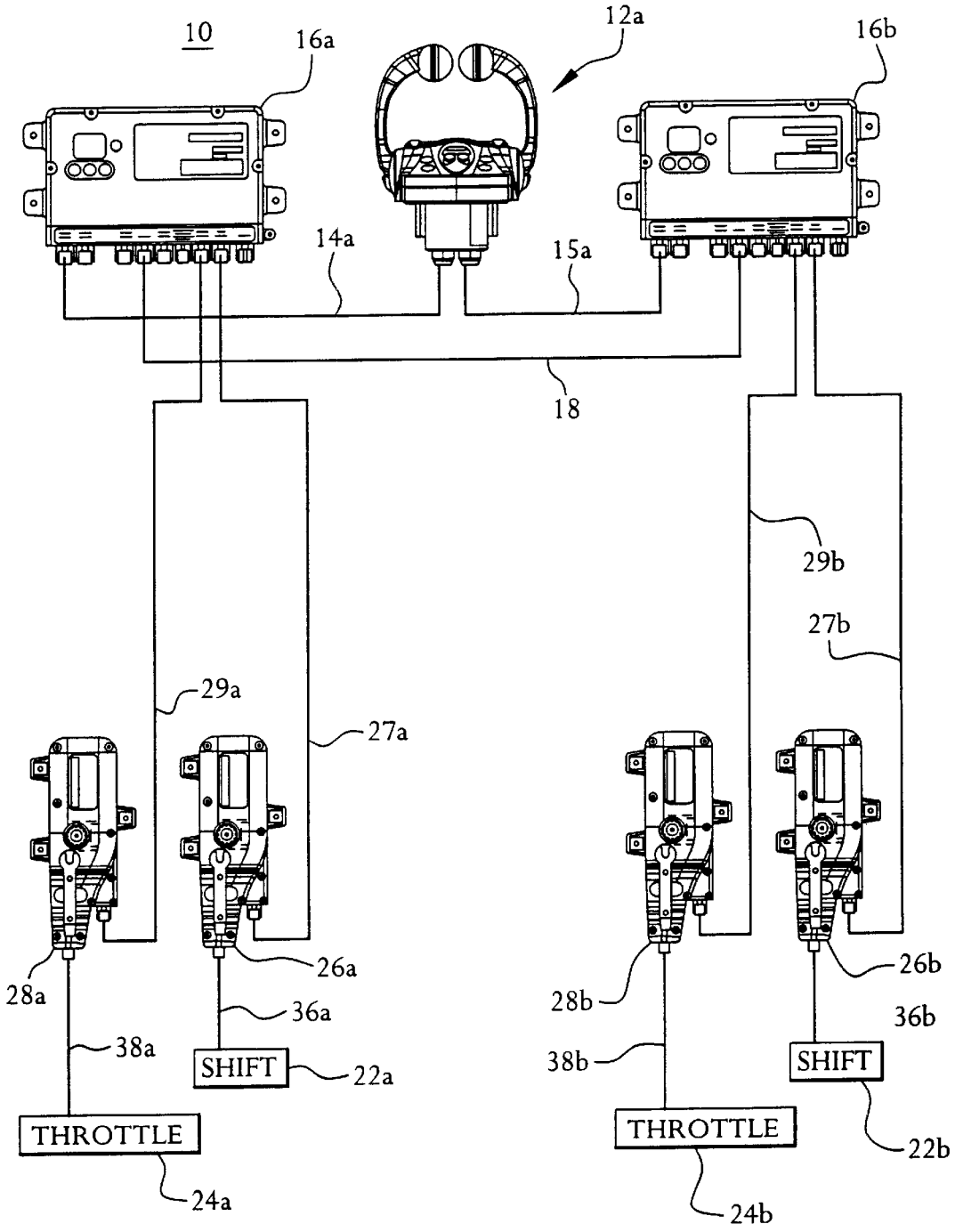
FIG. 4 depicts an alternate preferred embodiment of a control system according to the invention.

Though the control system 10 depicted in FIG. 3 includes two control heads 12*a*, 12*b*, two transmissions 22*a*, 22*b* and two engines 24*a*, 24*b*, it should be understood that a control system according to the invention can include any number of control heads 12, transmissions 22, and engines 24, depending on the requirements of the particular installation. For example, as shown in FIG. 4, a single control head 12 can be operatively coupled to a plurality of transmissions 22 and engines 24 via a plurality of ECUs 16. Alternatively, however, a plurality of control heads 12 can be operatively coupled to a single transmission 22 and engine 24. In such an embodiment, the plurality of control heads can be coupled to a single ECU 16. The ECU 16 can, in turn, be coupled to a shift actuator 26 that drives the transmission 24 and to a throttle actuator 28 that drives the engine 22.

Overview of Engine/Transmission Control

Figure 5:
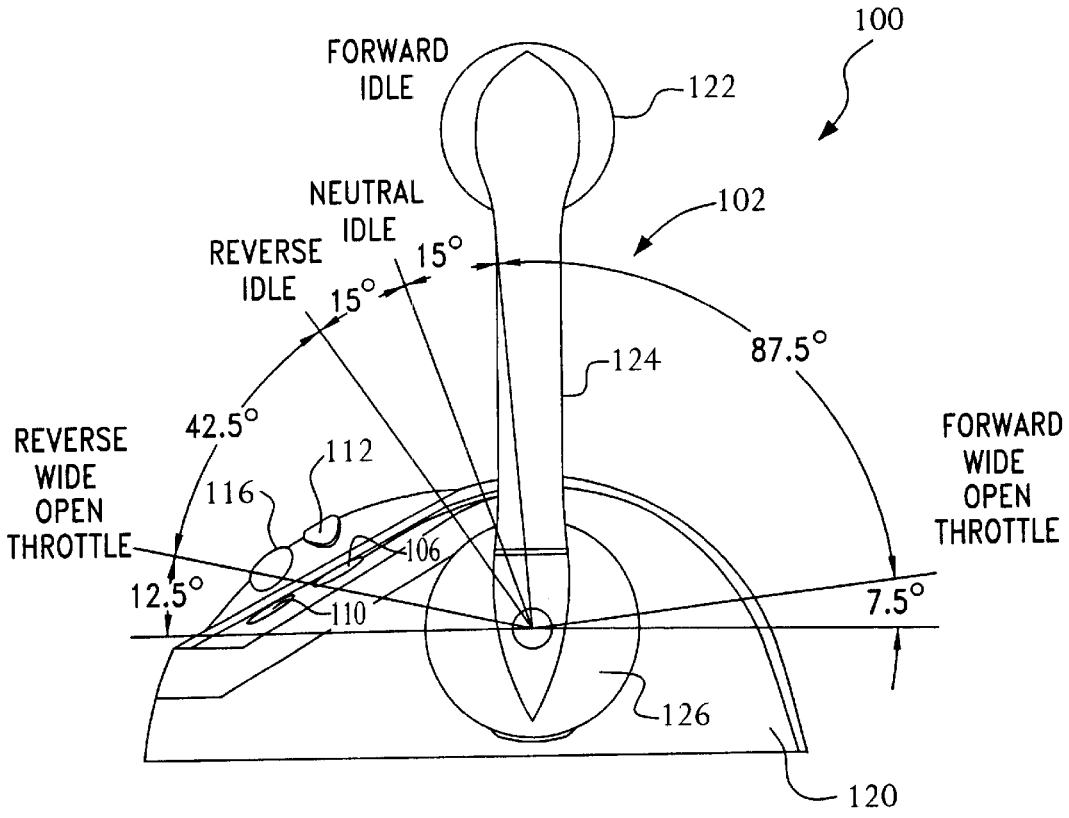
FIG. 5 is a side view of a control handle depicting the control handle's operational range.

To operate the vessel, the operator can move the control arm through its operating range from full reverse throttle to full forward throttle. Preferably, as shown in FIG. 5, the control arm has an operational range of 160 degrees. That is, the operator can move the control arm 160 degrees from full reverse throttle to full forward throttle. Preferably, the position of the control arm within its operating range dictates the throttle of the engine to which the control arm is coupled, as well as the shift position of the corresponding transmission.

For example, in the embodiment depicted in FIG. 5, a reverse wide open position exists at 12.5 degrees from the horizontal, a reverse idle position exists at 55 degrees, a neutral idle position exists at 70 degrees, a forward idle position exists at 85 degrees, and a forward wipe open throttle position exists at 172.5 degrees. The operator can vary forward throttle between forward idle and forward wide open throttle by moving the handle between 85 degrees and 172.5 degrees. Similarly, the operator can vary reverse throttle between reverse idle and reverse wide open throttle by moving the handle between 55 degrees and 12.5 degrees. Though the operating range of the control arm is depicted in FIG. 5 as extending over 160 degrees, it should be understood that the actual operating range of the control arm is independent of the principles of the invention.

Preferably, the control head includes a catch (not shown) at each of the aforementioned points along its operational range. In this way, an operator can detect by sense of feeling that the control arm has moved into a new shift/throttle position. Also, in a preferred embodiment, the control head includes a mechanical stop (not shown) at 12.5 and 172.5 degrees from the horizontal, thereby preventing the operator from moving the control arm beyond its 160 degree operational range.

Figure 6:
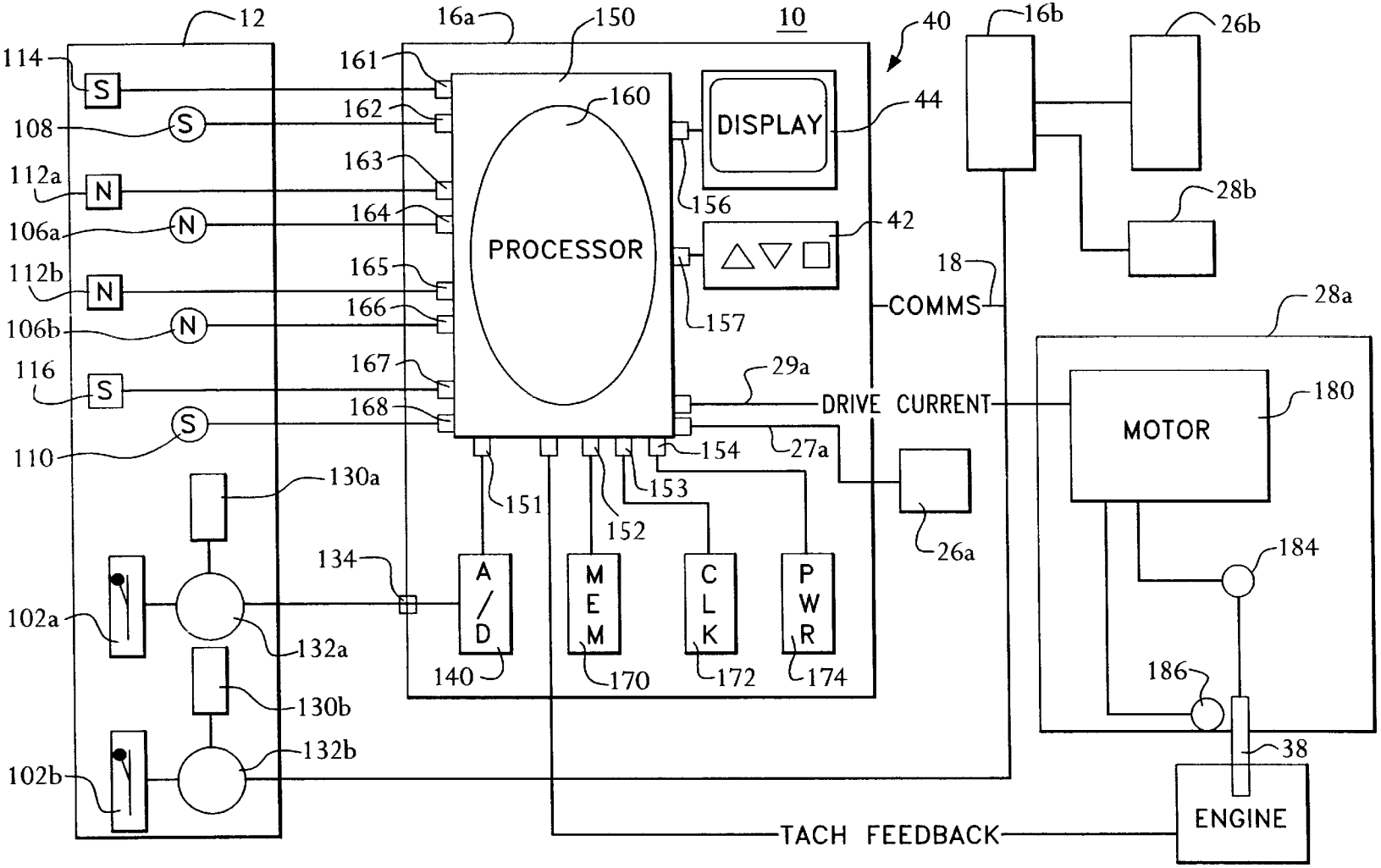
FIG. 6 is a block diagram of a preferred embodiment of a control system according to the invention.

FIG. 6 is a block diagram of an embodiment of a control system 10 according to the invention including a control head 12, a pair of ECUs 16*a*, 16*b*, shift actuators 26*a*, 26*b*, and throttle actuators 28*a*, 28*b*. For the sake of brevity, ECU 16*a* and throttle actuator 28*a* are described in detail, though it should be understood that ECU 16*b* and actuators 26*a*, 26*b*, and 28*a* can be similarly made and used.

The control head 12 includes a port control arm 102*a*, a starboard control arm 102*b*, a port control arm position sensor 132*a*, and a starboard control arm position sensor 132*b*. Each of the control arm position sensors 132 can include a potentiometer, for example, or other such device that senses the current position of the corresponding control arm 102 within its operating range. It should be understood that a potentiometer is merely an example of a position sensing device and that other position sensors, such as Hall effect sensors, for example, can also be used to sense the position of the control arm.

The position sensor 132 is electrically connected to an input pin 134 of the ECU 16 via an electrical conductor, such as a wire. The control head 12 includes a power supply 130 that provides an electrical signal to the position sensor 132. The position sensor 132 causes the voltage of the electrical signal to vary as the control arm 102 moves within its operating range. Preferably, the power supply is a 5 volt power supply. The potentiometer provides a variable resistance that causes the voltage of the electrical signal to vary linearly from 0.22 V, when the control arm 102 is in at 12.5 degrees (full reverse throttle), to 3.69 V, when the control arm 102 is at 172.5 degrees (full forward throttle). Thus, the voltage of electrical signal out of the potentiometer, which is forwarded to the input pin 134 of the ECU 16, represents the position of the control arm 102 within its operating range.

The ECU 16 includes an analog-to-digital (AID) convertor 140 that receives and digitizes the electrical signal from the control head 12. Preferably, the A/D converter 140 is a 10 bit A/D converter that provides a discrete value, ranging from 0 to 1023, that represents the voltage of the received signal. Thus, the operating range of the control arm 102 can be translated into 1024 discrete values, or "counts," with each count representing a voltage range of (3.69–0.22)/1024 volts.

The output of the A/D converter 140 is electrically connected to an input pin 151 of a host processor 150. The host processor 150, which is preferably an embedded microcontroller, hosts control software 160 that controls the ECU 16. The A/D converter 140 outputs the current count to the host processor 150. As described in detail below, the ECU 16 controls the shift position of the transmission and throttle of the engine based on the current count (which represents the current position of the control arm).

The control head 12 also includes a port engine neutral indicator 106*a*, a starboard engine neutral indicator 106*b*, a control head indicator 108, and an engine sync indicator 110. Each of the indicators is electrically connected to a respective output pin 162, 164, 166, 168 of the ECU's processor 150 via a corresponding wire or other such electrical conductor. Preferably, the indicators 106*a*, 106*b*, 108, and 110 are light emitting diodes (LEDs). More preferably, the engine neutral indicators 106*a*, 106*b* are amber LEDs, the control head indicator 108 is a green LED, and the engine sync indicator 110 is a blue LED. Electrical signals output from the ECU 16 cause the LEDs to light.

The control head 12 also includes a port neutral command input device 112*a*, a starboard neutral command input device 112*b*, a select command input device 114, and a sync command input device 116. Preferably, each of the input devices 112*a*, 112*b*, 114, and 116 is a button that is electrically connected to a respective input pin 161, 163, 165, 167 of the ECU 16 via a wire or other such electrical conductor. Each time a button is pushed, it generates an electrical signal, or impulse, that is forwarded to the ECU 16.

The ECU 16 also includes an operator interface 40 that includes a data input device 42, via which an operator can input data to the ECU 16, and a display or other data output device 44 via which the ECU 16 can provide information to the operator. The data input device 42 is electrically connected to an input pin 157 of the host processor 150. As shown, the data input device 42 can include one or more buttons or keys. The data output device 44 can be an LCD display, for example. The data output device 44 is electrically connected to an output pin 156 of the host processor 150.

Preferably, the ECU 16 includes a memory 170, a clock 172, and a power supply 174. Preferably, the memory 170 is an EEROM that is electrically connected to an input/output pin 152 of host processor 150. Preferably, the clock 172 is a crystal controlled device that is electrically connected to an input pin 153 of host processor 150. Preferably, the power supply 174 is a 12V power supply that is electrically connected to an input pin 154 of host processor 150.

The actuator 28 includes an electrical motor 180, an actuator rod 38, an electro-mechanical rod positioning device 184, and a rod position sensor 186. The motor 180 can be a servo-driven motor, for example, such as a DC permanent magnet type. The ECU's power supply is electrically connected to the actuator's motor via a pair of electrically conductive leads. The ECU 16 drives the motor 180 by providing a current to the motor. The current, which, preferably, is provided as a series of pulses, has an average duty cycle that the ECU can vary, thereby varying the amount of power that the ECU supplies to the motor.

The motor 180 is electrically coupled to the rod positioning device 184, which is mechanically coupled to the actuator rod 38. The motor 180 provides electrical power to the rod positioning device 184, which moves the actuator rod 38 accordingly. The rod positioning device 184 can include a gear train, such as a worm gear, for example, that is driven by the motor 180, and is coupled to a push/pull cable that provides linear motion to the actuator rod 38.

Each actuator rod has a range of movement. Preferably, the throttle actuator rod can be set to a first position that corresponds to wide open throttle, a second position that corresponds to fully closed throttle, or, in general, any position in between. As the rod is moved within its range of movement, the throttle opens or closes accordingly. Similarly, the shift actuator rod can be set a first position that corresponds to reverse, a second position that corresponds to neutral, and a third position that corresponds to forward. Preferably, the position of the actuator rod is expressed in terms of the percent of the actuator rod's range of movement. For example, the throttle actuator rod can be set at 0% of its range of movement for wide open throttle, and at 100% of its range of movement for fully closed throttle. Similarly, the shift actuator rod can be set at 0% of its range of movement for reverse, 50% for neutral, and 100% for forward.

The ECU 16 controls the shift position of the transmission and throttle of the engine based on the current position of the control arm. The ECU receives the electrical signal from the control head and determines, based on the voltage level of the signal, whether to vary throttle or shift position. From the voltage level of the received signal, the ECU determines the current position of the control arm. From the current position of the control arm, the ECU determines the positions to which the shift and throttle actuator rods should be set. Preferably, the ECU's memory contains a conversion table from which the ECU can determine the position to which an actuator rod should be set based on the position of the control arm. An exemplary conversion table is depicted in FIG. 7.

In a preferred embodiment, the operating range of the control arm is divided into 1024 discrete sub-ranges, or sectors. Each sector corresponds to a count, as described above. Thus, each time the control arm moves from a first sub-range into a second sub-range, the voltage of the electrical signal into the A/D convertor changes by one discrete voltage leap of, for example, (3.69–0.22)/1024 V. The count out of the A/D convertor varies accordingly. Thus, the current position of the control arm is mapped to a count. For example, when the control arm is at 12.5 degrees (reverse wide open throttle), the control head provides a 0.22V electrical signal the A/D, which outputs a count of 56.

Each count between reverse wide open throttle and forward wide open throttle also corresponds to a predefined position of the actuator rod. Thus, as the operator moves the control arm through its operating range, the voltage of the electrical signal that is sent to the ECU varies. For shift position, the ECU determines from the current count whether the control arm is in a reverse position (i.e., within the reverse sub-range of the control arm's operating range), a neutral position, or a forward position. The ECU then causes the shift actuator rod to be set to the appropriate position as described above. As for throttle, the ECU determines the percent of the throttle actuator from the current count, and causes the throttle actuator rod to be moved into a position that corresponds to that percentage of its range of movement.

Neutral Throttle Warm-up

Preferably, when power is initially applied to the system, the ECU causes the control system to default to ordinary neutral idle mode. That is, each transmission actuator causes its associated transmission actuator rod to move into a neutral position, and each throttle actuator causes its associated throttle actuator rod to move into a default neutral throttle position, which causes the engine to idle at a default neutral idle throttle rate, which is typically set by the engine's manufacturer.

Figure 8A:
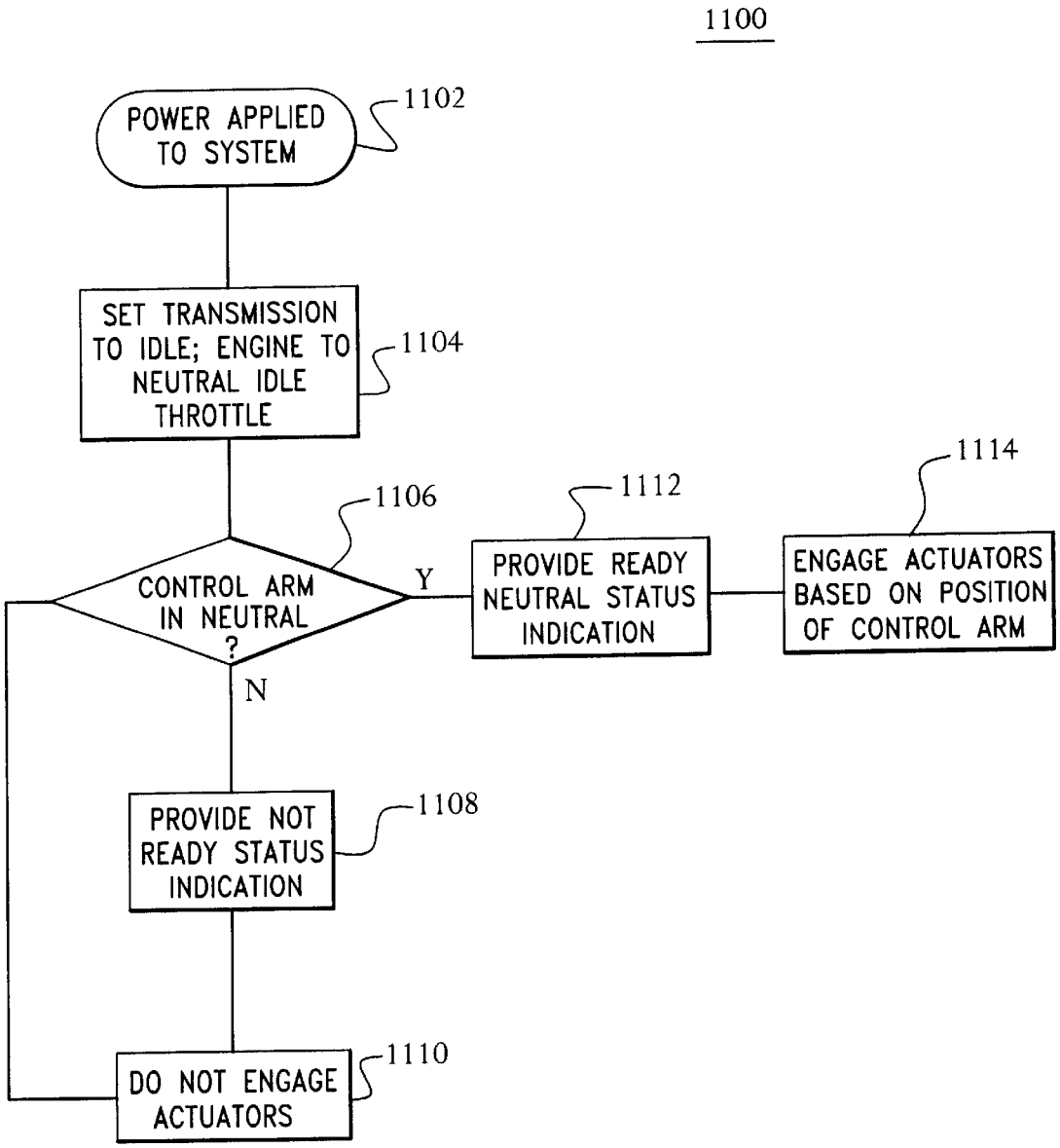
FIGS. 8A–8G provide flowcharts for methods according to aspects of the invention that can be implemented into a control system for a marine vessel.

FIG. 8A is a flowchart of the ECU's power up algorithm 1100. At step 1102, power is applied to the ECU, and the ECU's host processor executes a startup routine. At step 1104, the ECU causes the corresponding transmission to be set to idle, and the corresponding throttle to be set to the default neutral throttle rate. The ECU reads from a startup table stored in its memory, a value that corresponds to a neutral position of the shift actuator rod. The ECU then causes the shift actuator to move the shift actuator rod into a neutral position by applying the appropriate power to the shift actuator's motor. Similarly, the ECU reads from the startup table stored in its memory, a default value that corresponds to the ordinary neutral position of the throttle actuator rod. The ECU then causes the throttle actuator to move the throttle actuator rod into its default neutral position by applying the appropriate power to the throttle actuator's motor.

Preferably, for safety reasons, the control system prevents the transmission from engaging (i.e., moving into a forward or reverse position) until after the control lever is moved into a neutral position. Accordingly, the ECU determines, at step 1106, whether the control arm is in a neutral position.

If the ECU determines at step 1106 that the control arm is not in a neutral position, the ECU causes the neutral status indicator 106 to provide, at step 1108, an indication that the transmission is in a neutral position, but the control lever is not, and, therefore, that the control system will not engage the transmission. In an embodiment wherein the neutral status indicator is an LED, for example, the ECU can provide the first neutral status indication by causing the LED to remain unlit (i.e., the ECU provides no current to the LED).

When ECU senses that the control lever 102 has been moved into a neutral position (i.e., within the predefined sub-range of its operating range that corresponds to neutral), the ECU causes the neutral indicator 106 to provide an indication that both the transmission and the control lever are in the neutral position, and, therefore, that the control system is now ready to engage the transmission. For example, in an embodiment wherein the neutral status indicator is an LED, the ECU can cause the LED to light and remain lit by providing a steady current to the LED.

Until the ECU senses, at step 1106, that the control arm has been moved into a neutral position, the ECU, at step 1110, otherwise ignores the position of the control arm. That is, until the ECU senses that the control arm has been moved into a neutral position, the ECU does not move either the throttle actuator or shift actuator out if its default neutral position.

After the ECU senses, at step 1106, that the control arm has been moved into a neutral position, the ECU, at step 1112, causes the neutral status indicator to provide a second neutral status indication, e.g., by causing the neutral status indicator to remain lit. Thereafter, at step 1114, the ECU causes the throttle and shift position to correspond to the position of the control arm as described above.

Figure 8B:
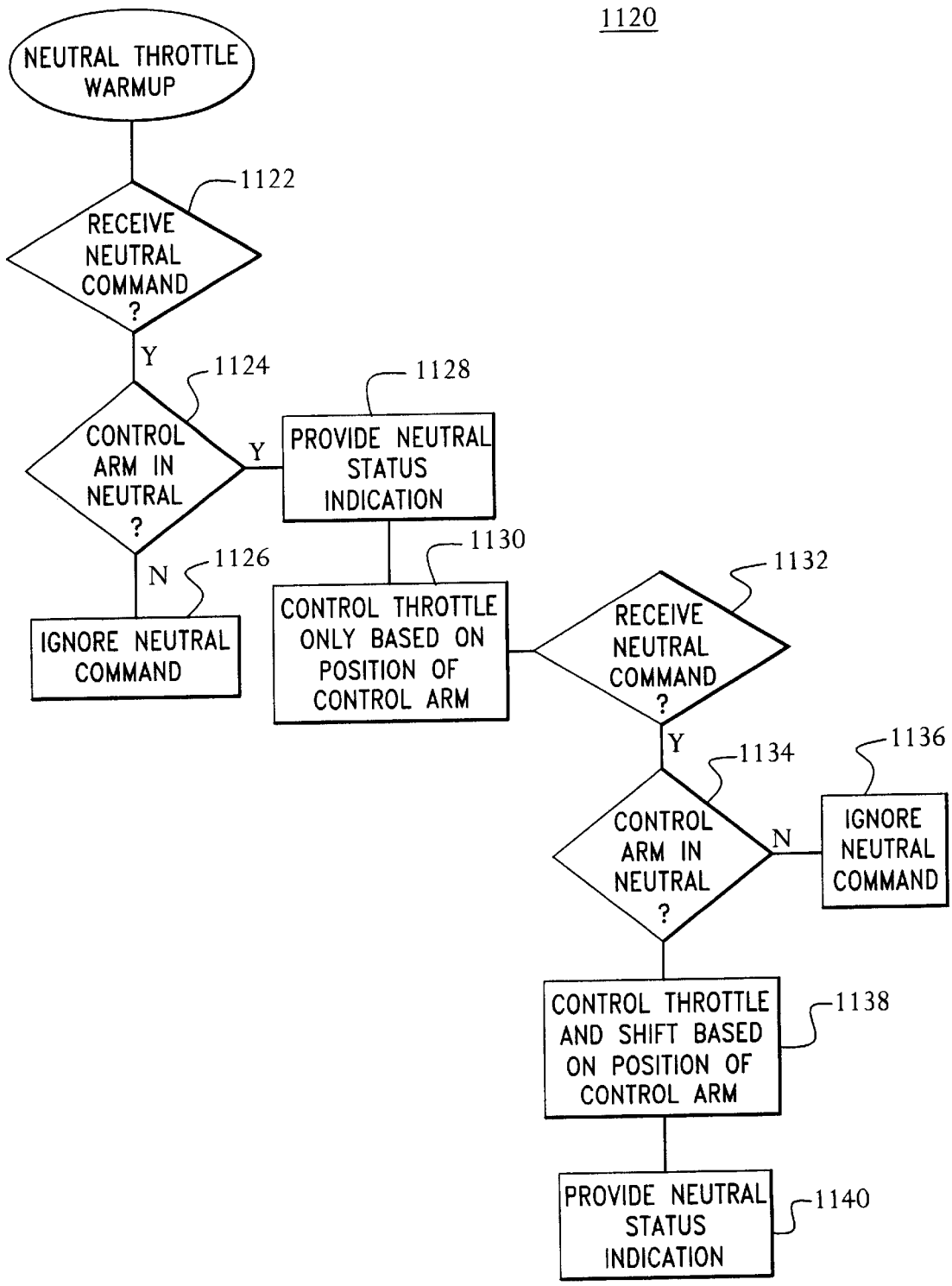

According to the invention, the operator can vary the neutral idle rate from the manufacturer-provided default by entering a "neutral idle warmup" mode. FIG. 8B is a flowchart of a method 1120 according to the invention for providing a neutral throttle warmup mode. Preferably, to enter neutral idle warmup mode, the operator moves the control arm into a neutral position, and inputs a neutral command to the control system via the neutral command input device. In a preferred embodiment, the operator enters a neutral command by pushing the neutral button, which causes an electrical impulse to be transmitted to the ECU. At step 1122, the ECU determines whether a neutral command has been received from the control head.

If, at step 1122, the ECU receives a neutral command from the control head, at step 1124 the ECU determines whether the control arm is in a neutral position. If, at step 1124, the ECU determines that the control arm is not in a neutral position, the ECU, at step 1126, ignores the neutral command. (In a preferred embodiment having either split range throttle or programmable idle capability, both of which are described in detail below, the ECU does not ignore the neutral command until first determining whether the control arm is in a gear idle position.)

If, at step 1124, the ECU determines that the control arm is in a neutral position, the ECU, at step 1128, enters neutral throttle warmup mode and causes the neutral status indicator to provide an indication that the control lever can be used to vary the idle throttle rate (i.e., increase or decrease the throttle of the associated engine without engaging the associated transmission). In an embodiment wherein the neutral status indicator is an LED, the ECU causes the LED to flash at a predetermined rate by transmitting a series of electrical pulses to the LED.

The operator can then vary the neutral idle throttle rate of the associated engine by moving the control lever to forward or reverse throttle. At step 1130, the ECU senses the position of the control arm, and causes the throttle actuator to vary the throttle as described above, based on the position of the control arm. The ECU does not engage the transmission, however. That is, the ECU does not cause the shift actuator to move the shift actuator rod out of its neutral position while in neutral throttle warmup mode. Thus, in neutral throttle warmup mode, the control system enables the operator to maintain a neutral shift position, while increasing the idle throttle rate.

Preferably, the operator can cause the system to exit neutral throttle warmup mode by returning the control arm to a neutral position, and inputting a neutral command to the control system via the neutral command input device. Accordingly, at step 1132, the ECU the ECU determines whether a neutral command has been received from the control head. If, at step 1132, the ECU receives a neutral command from the control head, at step 1134 the ECU determines whether the control arm is in a neutral position. If, at step 1134, the ECU determines that the control arm is not in a neutral position, the ECU, at step 1136, ignores the neutral command.

If, at step 1134, the ECU determines that the control arm is in a neutral position, the ECU exits neutral throttle warmup mode. Thereafter, at step 1138, the ECU causes both the throttle actuator and the shift actuator to position their respective actuator rods based on the position of the control arm. Additionally, at step 1140, the ECU causes the neutral status indicator to provide an indication that the system has been returned to ordinary idle mode (i.e., that the transmission will now be engaged based on the position of the control arm). In an embodiment wherein the neutral status indicator is an LED, the ECU causes the LED to remain lit by transmitting a continuous electrical signal to the LED.

To determine which idle mode the system is in at any time, the ECU stores in its memory a neutral idle status flag that indicates whether the system is in startup mode, ordinary neutral idle mode, or neutral throttle warmup mode. On startup, the flag can be set to a default startup value (e.g., "0) to indicate that the actuators are in neutral, but the control lever has not yet been moved into a neutral position. When the ECU senses that the control lever has been moved into a neutral position, the value of the neutral status flag can be set to a second value (e.g., "1") that indicates that the system is in ordinary idle mode. Thereafter, if, while the system is in ordinary idle mode, the operator inputs a neutral command while the control arm is in a neutral position, the value of the neutral status flag can be set to a third value (e.g., "2") that indicates that the system is in neutral throttle warmup mode. If, while the system is in neutral throttle warmup mode, the operator inputs a neutral command while the control arm is in a neutral position, the value of the neutral status flag can be set to the value (e.g., "1") that indicates that the system has been returned to ordinary neutral idle mode.

As the ECU receives control arm position data, it determines whether the system is in startup mode, ordinary idle mode, or neutral throttle warmup mode by reading the value of the flag from memory. If the system is in neutral throttle warmup mode, the ECU controls the position of the throttle actuator rod based on the position of the control arm, but does not move the shift actuator rod out of its neutral position. If the system is in ordinary idle mode, the ECU controls the positions of both the throttle actuator rod and the shift actuator rod, based on the position of the control arm. If the system is in startup mode, the ECU does not move either the throttle actuator rod nor the shift actuator rod, regardless of the position of the control arm.

Station Transfer

For safety reasons, in an installation having more than one control station, only one control station can control the operation of the boat at any given time. On occasion, however, the operator desires to transfer control from one control station to another. Preferably, the operator can initiate such a transfer of control regardless of the current throttle rate or shift position.

To initiate a station transfer, the operator enters a select command (e.g., by pushing the "select" button) at the station to which control is to be transferred (the transferee station). In a preferred embodiment, the select command input device is electrically connected, via a wire, to an input pin in the ECU. Pushing the "select" button causes a select command, such as an electrical impulse, to be communicated to the ECU. In response to the operator's entering the select command, the one or more control status indicators at the transferee station indicate that control is in the process of being transferred to that station. For example, in an embodiment wherein the control status indicator is an LED, the LED can be made to flash.

Then, at the transferee station, the operator matches the lever position to within a predefined percentage of the position of the control lever at the transferring station. Preferably, the predefined percentage is 10%. When the levers at both stations are matched to within 10% of each other, transfer of control occurs. The control status indicators at both stations then indicate that the transfer has successfully occurred, and that the transferee station is now in control of the vessel. In an embodiment wherein the control status indicators are LEDs, the LED at the transferee station can be made to light and remain lit, while the LED at the transferring station can be turned off.

For safety reasons, when the select command is entered at the transferee station, a timer is initiated for a transfer completion period. Preferably, the timer is initiated in the ECU, and the transfer completion period is five seconds. That is, the operator has five seconds from the time he initiates transfer by entering the select command until the time he completes transfer by moving the control lever(s) into a position that matches the position of the control lever(s) at the transferring station. If the ECU does not sense that the control arm at the transferee station is has been moved to within 10% of the position of the control arm at the transferring station before the timer expires, the ECU will not permit control to be transferred to the transferee station. That is, if the operator does not complete station transfer within the transfer completion period, control will remain with the transferring station.

Additionally, if the ECU receives a select command from the transferring station after the select command has been received from the transferee station but before the control levers are matched, the transfer will be aborted and the transferring station will remain in control. Thus, the operator's entering a select command at the transferring station before the transfer is complete will prevent the transferee station from assuming control.

According to an aspect of the invention, the control system can be configured to require the operator to enter a station protect sequence in order to transfer control from the transferring station to the transferee station. Preferably, the ECU can be programmed to enable either standard station transfer, as described above, or protected station transfer, which requires the entry of a station protect sequence.

In station protect mode, the operator is required to enter a sequence of commands from the transferee station, and to match the control levers at the transferee station to within a predefined tolerance of the lever positions at the transferring station within a short timeout period after the sequence is entered. Preferably, the command sequence is a predefined sequence of commands that the operator can enter from the control station using the select command input device and the neutral command input device. More preferably, the command sequence starts with a select command (to avoid confusion with other functions that can be initiated by entry of a neutral or sync command).

In a preferred embodiment, the transfer command sequence is "select, select, neutral, select." That is, the operator is required to input a first select command, a second select command, a neutral command, and then another select command, before the timer expires, or the transfer attempt will be aborted.

The operator can enter the transfer command sequence by pushing the corresponding buttons on the face of the housing of the control head. As the operator enters the commands, the ECU receives the commands and compares the received command sequence against the predefined transfer command sequence. If the received command sequence matches the predefined transfer sequence, the ECU initiates a timer, and determines the positions of the control levers at both the transferring and transferee stations. If, within the timeout period, which is preferably five seconds, the ECU determines that the positions of the levers at the transferee station are within tolerance (e.g., 10%) of the positions of the levers at the transferring station, the transfer takes effect. Otherwise, the transfer times out, and control remains at the transferring station.

Preferably, the control status indicators at both stations continuously provide an indication as to the state of the transfer. For example, once the select button is hit the first time at the transferee station, the control status indicators flash at both stations. At that point, an operator at the transferring station can override the attempted takeover by hitting the select button at the transferring station. If the transfer is aborted, or does not occur within the predefined timeout, the status indicator at the transferring station remains lit, and the status indicator at the transferee station is turned off. If transfer is successfully completed, however, the control status indicator at the transferee station remains lit, while the control status indicator at the transferring station is turned off.

Figure 8C:
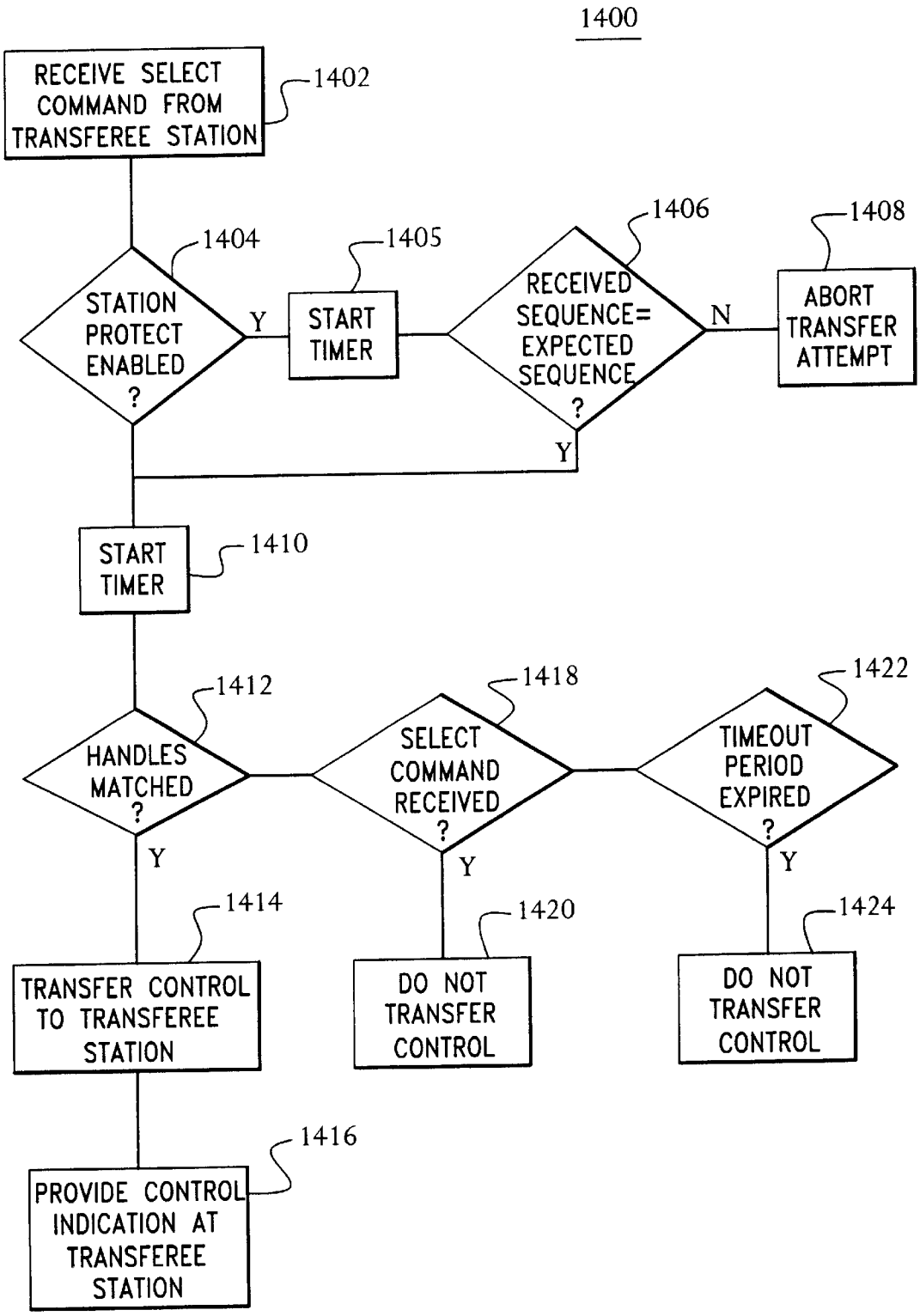

FIG. 8C is a flowchart of a station protection algorithm 1400. At step 1402, the ECU receives a select command from the control head at the transferee station (a select command received from a station that is in control of the vessel is ignored). At step 1404, the ECU checks the value of a data flag stored in memory to determine whether the system has been configured with station protect. If, at step 1404, the ECU determines that the system has been configured with station protect, the ECU, at step 1405, starts a sequence timer and waits to receive a sequence of commands from the control head at the transferee station. If the ECU determines at step 1406 that the received sequence does not match the expected sequence, or if the timer expires, the ECU ignores the select command at step 1408 and does not transfer control to the transferee station.

If the ECU determines at step 1404 that the system is not configured with station protect, or if the system is configured with station protect and the correct sequence has been received, the ECU, at step 1410, starts a transfer timer. If, at step 1412, the ECU determines that the control arms are aligned to within a certain tolerance of each other before the timer expires, the ECU transfers control to the transferee station at step 1414. At step 1416, the ECU causes the select indicator to light at the transferee station and to turn off at the transferring station. Thereafter, the ECU controls the vessel based on the position of the control arms at the transferee station.

If, at step 1418, the ECU receives a select command from the transferring station before the timer expires, the ECU aborts the attempt to transfer control at step 1420. If the timer expires, at step 1422, the ECU aborts the attempt to transfer control at step 1424.

Programmable Idle

Preferably, when the control handle is placed into the forward idle position, the ECU causes the throttle actuator to position the throttle actuator rod such that the engine throttles at its default forward idle throttle rate. Similarly, when the control handle is placed into the reverse idle position, the ECU causes the throttle actuator to position the throttle actuator rod such that the engine throttles at its default reverse idle throttle rate. Typically, the default idle throttle rates are set by the engine's manufacturer.

According to another aspect of the invention, an operator can change the idle throttle rate from the default rate to an alternate, user-provided idle throttle rate. Preferably, the ECU is programmable, and includes an operator interface via which the operator can specify either or both of an alternate forward idle throttle value and an alternate forward idle throttle value.

Figure 8D:
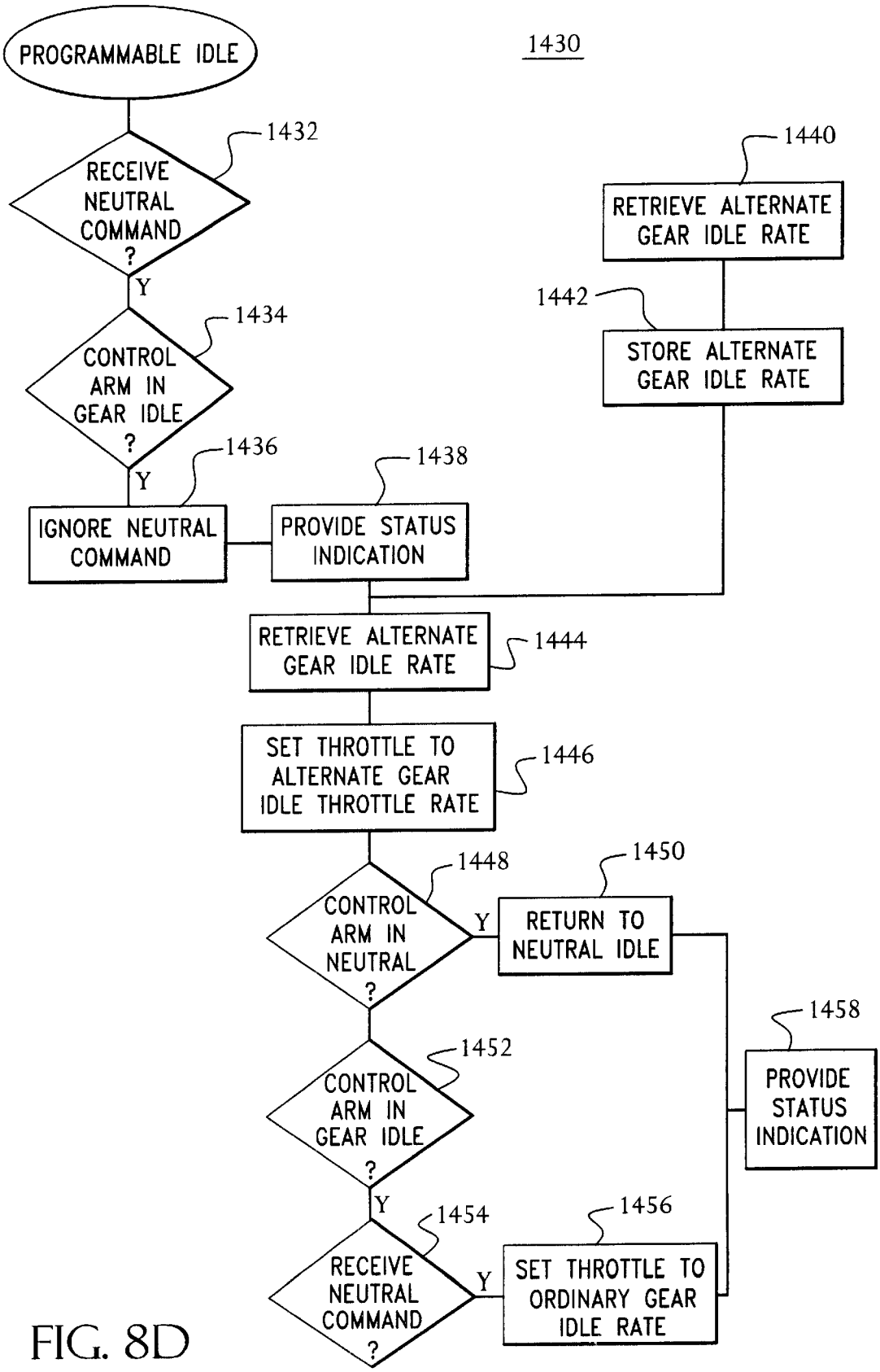

FIG. 8D is a flowchart of a method 1430 according to the invention for providing a programmable idle capability in a control system for a marine vessel. At step 1440, the operator enters, and the ECU receives, an alternate gear idle throttle value for either or both of forward idle and reverse idle. Preferably, the gear idle throttle rates are expressed as a percentage of full throttle, with the percentage ranging from 0% (ordinary idle) to 40%. Preferably, the operator can select from a number of available options that the ECU provides via its visual display. The ECU stores the options in its memory, and presents them to the operator on command. The operator can then use the ECU's input device to scroll through the list of available options and select one. Alternatively, the ECU can enable the operator to enter any value within the acceptable range. At step 1440, the ECU stores the operator-provided gear idle throttle value(s) in memory as a percentage of the range of movement of the throttle actuator rod.

Preferably, to change the idle throttle from the default value to the user-specified value, the operator first moves the control handle into a gear idle position (i.e., either the forward idle position or the reverse idle position), and then inputs a neutral command to the control system via the neutral command input device. In a preferred embodiment, the operator enters a neutral command by pushing the neutral button, which causes an electrical impulse to be transmitted to the ECU. At step 1432, the ECU determines whether a neutral command has been received from the control head.

If, at step 1432, the ECU receives a neutral command from the control head, at step 1434 the ECU determines whether the control arm is in a gear idle position. If, at step 1434, the ECU determines that the control arm is not in a gear idle position, the ECU, at step 1436, ignores the neutral command. (In a preferred embodiment having neutral throttle warmup capability, which is described in detail above, the ECU does not ignore the neutral command until first determining whether the control arm is in a neutral position.)

If, at step 1434, the ECU determines that the control arm is in a gear idle position, the ECU, at step 1438, enters alternate idle mode and causes the neutral status indicator to provide an indication that the system is in the alternate idle throttle mode. In an embodiment wherein the neutral status indicator is an LED, the ECU causes the LED to flash at a predetermined rate by transmitting a series of electrical pulses to the LED.

At step 1444, the ECU reads from memory the alternate idle throttle value for that gear (either forward or reverse) and, at step 1446, causes the throttle actuator to position the throttle actuator rod to the position within its range of movement that corresponds to the alternate idle throttle value. The ECU also causes the shift actuator to position the shift actuator rod at the position corresponding to the gear (forward or reverse) to which the control arm has been set. While the system is in alternate idle throttle mode, the ECU will disregard any movement of the control handle within the gear.

To disengage the system from alternate idle throttle mode, the operator can either move the control arm into a neutral position or enter a neutral command while the control arm is in a gear idle position. Accordingly, if, at step 1448, the ECU determines that the control arm has been moved into a neutral position, the ECU, at step 1450, causes the shift actuator to position the shift actuator rod at its neutral position, and causes the throttle actuator to position the throttle actuator rod at its default neutral idle position.

If, at step 1452, the ECU determines that the control arm is in a gear idle position and, at step 1454, the ECU receives a neutral command while the control arm is in a gear idle position, the ECU, at step 1456, causes the throttle actuator to position the throttle actuator rod at its default gear idle position. In either event, at step 1458, the ECU also causes the neutral status indicator to provide an indication that the system has been returned to default idle throttle mode (e.g., the neutral LED can be turned off).

Split Range Throttle

The sensitivity of the control handle is a fiction of the engine throttle range that corresponds to the forward throttle operating range of the control arm. For example, in a preferred embodiment, forward throttle corresponds to an 87.5 degree sub-range of the operating range of the control arm. Though the full forward throttle rate typically varies by engine, an exemplary full forward throttle rate can be approximately 4500 rpm. Thus, in such an embodiment, while the system is in ordinary throttle mode, the 87.5 degree forward throttle operating range of the control arm would correspond to an engine throttle range of 4500 rpm. Similarly, reverse throttle corresponds to an 42.5 degree sub-range of the operating range of the control arm. An exemplary full reverse throttle can be approximately 4500 rpm. Thus, in such an embodiment, while the system is in ordinary throttle mode, the 42.5 degree reverse throttle operating range of the control arm would correspond to an engine throttle range of 4500 rpm.

As described in detail above, after the ECU receives the control arm position signal from the control head, the ECU converts the signal voltage into a count ranging from 0 to 1023. In a preferred embodiment, the forward throttle range corresponds to counts 460 to 920. That is, each count in the forward throttle range corresponds to an approximately 0.20 degree movement in the control arm. In the exemplary system wherein full forward throttle is approximately 4500 rpm, each count would correspond to an approximately 10 rpm difference in engine throttle rate.

To increase the sensitivity of the control arm, a control system according to the invention enables an operator to select an alternate range of throttle that is less than the default range. The alternate full throttle rate can be a fixed percentage of full throttle (preferably 40%), or system can permit the operator to specify, via the ECU's user interface, an alternate full throttle rate of up to 40% of the default full throttle rate. The number of counts that correspond to the operational range of the control handle, however, does not change. Thus, the sensitivity of the control handle can be improved because each count within the operational range of the control handle will correspond to a smaller range of throttle.

For example, where the alternate full forward throttle is set to 40% of the default, each count, or 0.20 degree movement in the control arm, would correspond to an approximately 4 rpm difference in engine throttle rate. Consequently, in alternate throttle mode, the operator would have to move the control arm a greater distance along its operational range to change engine throttle the same amount as in ordinary throttle mode. Thus, the sensitivity of the control arm can be increased, thereby providing the operator with more control over changes in throttle.

Preferably, the ECU contains a default throttle table, such as described above in connection with FIG. 7, that maps the position of the control handle to a corresponding position of the throttle actuator rod when the system is in ordinary throttle mode. The ECU also contains an alternate throttle table that maps the position of the control handle to a corresponding position of the throttle actuator rod when the system is in alternate throttle mode. The operator can program the ECU by entering an alternate throttle value that represents the percentage of the default throttle range that the system will cover when the system is placed into alternate throttle control mode.

Figure 8E:
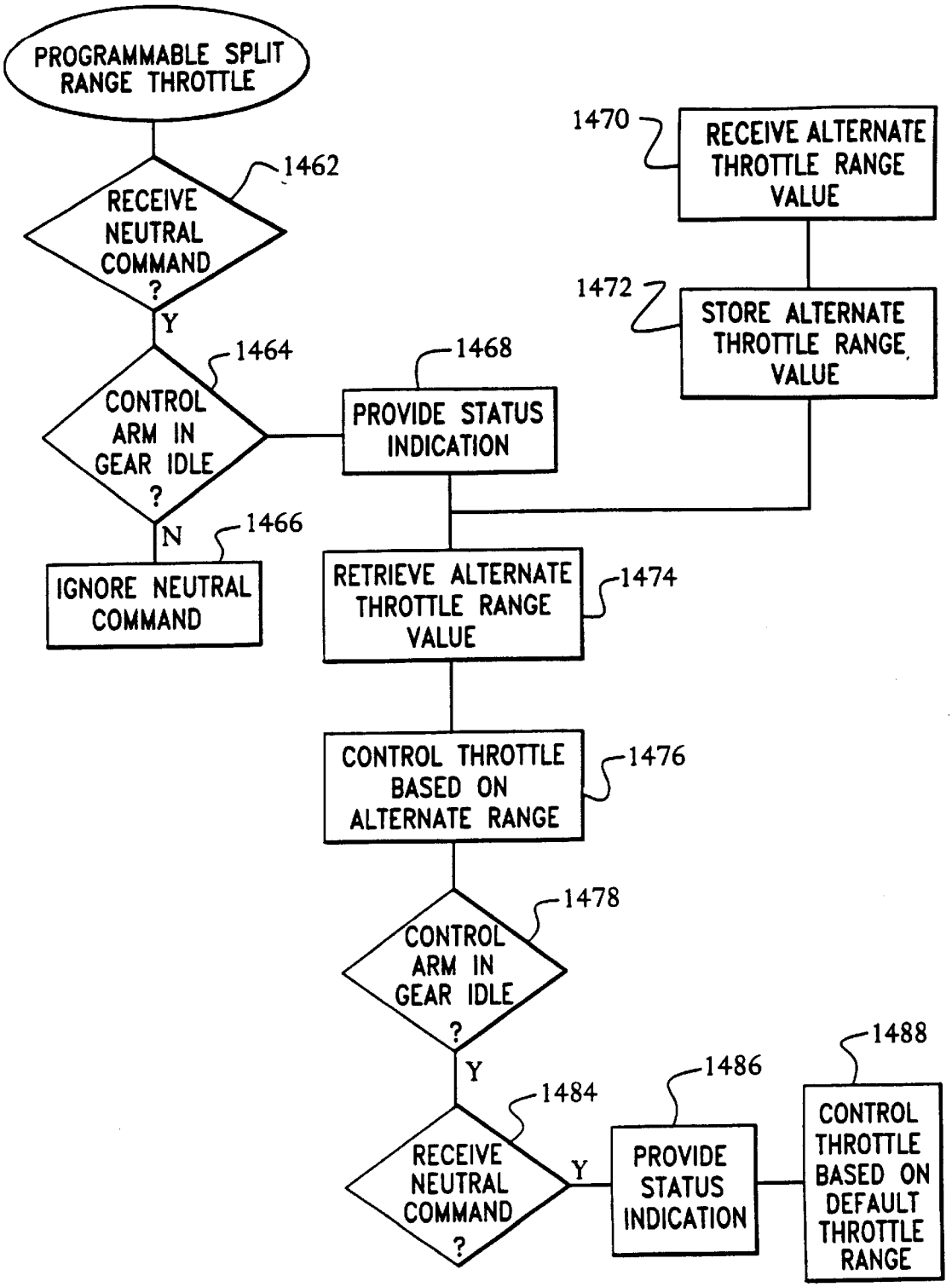

FIG. 8E is a flowchart of a method 1460 according to the invention for providing a programmable split range throttle capability in a control system for a marine vessel. At step 1470, the operator enters, and the ECU receives, an alternate throttle range value. Preferably, the alternate throttle range value is expressed as a percentage of the default throttle range. Preferably, the operator can select from a number of available options that the ECU provides via its visual display. The ECU stores the options in its memory, and presents them to the operator on command. The operator can then use the ECU's input device to scroll through the list of available options and select one. Alternatively, the ECU can enable the operator to enter any value within the acceptable range. At step 1472, the ECU stores the operator-provided throttle range value in memory as a percentage of the default throttle range.

Preferably, to change the throttle range from the default range to the alternate, user-specified range, the operator first moves the control handle into a gear idle position (i.e., either the forward idle position or the reverse idle position), and then inputs a neutral command to the control system via the neutral command input device. In a preferred embodiment, the operator enters a neutral command by pushing the neutral button, which causes an electrical impulse to be transmitted to the ECU. At step 1462, the ECU determines whether a neutral command has been received from the control head.

If, at step 1462, the ECU receives a neutral command from the control head, at step 1464 the ECU determines whether the control arm is in a gear idle position. If, at step 1464, the ECU determines that the control arm is not in a gear idle position, the ECU, at step 1466, ignores the neutral command. (In a preferred embodiment having neutral throttle warmup capability, which is described in detail above, the ECU does not ignore the neutral command until first determining whether the control arm is in a neutral position.)

If, at step 1464, the ECU determines that the control arm is in a gear idle position, the ECU, at step 1468, enters alternate throttle range mode and causes the control head to provide an indication that the system is in the alternate throttle range mode. In an embodiment wherein the neutral status indicator is an LED, the ECU causes the neutral status indicator LED to flash at a predetermined rate by transmitting a series of electrical pulses to the LED.

At step 1474, the ECU reads from memory the alternate throttle range value for that gear (either forward or reverse). Thereafter, at step 1476, the ECU uses the alternate throttle range value to position the throttle actuator rod based on the position of the control arm. That is, rather than converting the position of the control arm into a percent of range value for the throttle actuator rod based on the default table, the ECU converts the position of the control arm into a percent of range of the actuator rod based on the alternate table. In other words, the ECU positions the throttle actuator rod at the operator-entered percentage of the position it would be set in ordinary throttle mode. Thus, while the system is in alternate throttle mode, positioning the control arm at full throttle causes the ECU to position the throttle actuator rod at the operator-specified percentage of full throttle.

Preferably, the ECU includes a memory location that contains a flag that indicates whether the system is in default throttle control mode or alternate throttle control mode. In default throttle control mode, the full operational range of the control handle corresponds to the default full range of throttle. In alternate throttle control mode, the full operational range of the control arm corresponds to the alternate range of throttle. If the ECU receives a neutral command while the control handle is in a gear idle position, the ECU sets the flag to indicate that the system is in alternate throttle mode, and, thereafter, uses the alternate throttle table rather than the default throttle table to map control arm position to actuator rod position.

To disengage the system from alternate throttle control mode, the operator enters a neutral command while the control arm is in a gear idle position. If, at step 1478, the ECU determines that the control arm is in a gear idle position and, at step 1484, the ECU receives a neutral command while the control arm is in a gear idle position, the ECU causes the throttle actuator to position the throttle actuator rod at its default gear idle position. At step 1486, the ECU also causes the neutral status indicator to provide an indication that the system has been returned to default throttle mode (e.g., the neutral LED can be turned off). Thereafter, at step 1488, the ECU uses the default throttle control table to map control arm position to throttle actuator rod position.

In a preferred embodiment, a system according to the invention includes either split range throttle or programmable idle, but not both. It should be understood, however, that, in general, a system can include both split range throttle or programmable idle without departing from the principles of the invention. Preferably, the ECU includes a memory location that contains a option indicator flag that indicates whether the system includes split range throttle or programmable idle. Whenever the ECU senses that a neutral command has been entered while the control handle is in a gear idle position, the ECU first determines from the value of the option indicator flag whether the system includes split range throttle, programmable idle, or neither. If the system, includes neither, the ECU ignores the neutral command. If the system includes either split range throttle or programmable idle, the ECU engages (or disengages) whichever capability the system includes as described above.

Power Train Synchronization

According to another aspect of the invention, the control system enables the operator to control a plurality of power trains (i.e., engine/transmission pairs) using a single control lever. Preferably, the control system enables the operator to control both port and starboard power trains via a single, master control lever. Thus, in contrast to known systems, a control system according to the invention provides for synchronized control of a plurality of engines in forward, neutral, and reverse.

To place the system into sync mode, the operator enters a sync command (e.g., by pushing the "sync" button) at the control head. (Note that power train synchronization can be provided in a control system having a plurality of engines regardless of the number of control heads.) In response, the sync status indicator provides an indication that the system is now ready to go into sync mode. For example, in an embodiment wherein the sync status indicator is an LED, the LED can be made to flash. To enter sync mode, the operator must then match the lever position of the several control levers. Preferably, the levers are considered matched when they are within 10 percent of each other. When the levers are matched, the system is placed into sync mode, and the master control lever now controls the plurality of engines. The sync status indicator provides an indication that the system is in sync mode. For example, in an embodiment wherein the sync status indicator is an LED, the LED can be made to light and remain lit.

While in sync mode, the master control arm controls the positions of the plurality of transmission actuator rods, as well as the positions of the plurality of throttle actuator rods, based on the current position of the master control arm.

To control the positions of the plurality of transmission actuator rods, the master ECU determines whether the control arm is in a reverse, neutral, or forward position. The master ECU then positions the master transmission's actuator rod into its corresponding position. Additionally, the master ECU communicates the current shift position to the slave ECU(s) via the communications link. The slave ECU receives the shift position data and positions the slave transmission's actuator rod into its corresponding position. Thus, a plurality of transmissions can be controlled from a single lever.

Preferably, the master ECU communicates to the slave ECU a data packet containing representations of the following information: Percent Throttle, Gear, RPM, Station Select Request, Lamp Intensity, Neutral Throttle Warmup Active, Split Range or Programmable Idle, Request to Sync, Sync Fail, Sync Slave Active and Levers in Sync. In a preferred embodiment, this data is communicated 10 times per second and is communicated whether sync is active or not. The slave ECU is always monitoring the sync request command. When sync is achieved then the slave ECU uses all the data.

To control the positions of the plurality of throttle actuator rods, a control system according to the invention preferably includes a multi-stage engine synchronization algorithm designed to provide the slave engine with smooth responses to changes in the master engine's throttle. Ideally, the control system is designed to keep both engines in as near to perfect synchronization as possible at all times (to keep the vessel from vacillating from side to side as it moves forward, for example). In practice, however, the engines will likely be somewhat out of sync as the operator varies throttle via the master control arm. This effect is typically caused because of delays in commanding the slave engine into the same throttle position as the master engine.

In a first stage of the multi-stage engine synchronization algorithm, lever synchronization, the system provides the slave engine with a throttle value based on the percent throttle of the master engine. That is, the master ECU determines the current percent of throttle based on the current position of the master control arm as described above. The master ECU communicates its current percent of throttle to the slave ECU, which, in turn, commands the slave engine to achieve the same percent of throttle.

Due to differences between master and slave engine throttle percentages, however, lever synchronization typically provides only an approximation for throttle response. To account for any differences that may exist between engines, a control system according to the invention can include an offset table, preferably stored in a memory in the ECU, that provides a map of master engine percent throttle to a corresponding position of the slave engine throttle actuator rod. Thus, when the slave ECU receives the percent throttle data from the master ECU, the slave ECU can "fine tune" the position of its corresponding throttle actuator rod based on the mapping data in the offset table.

To produce this table, another stage of synchronization is performed. This stage, tach sync, provides a fine adjustment to engine throttle by comparing tachometric data from the engines. When the master and slave engines are within a predefined rate tolerance, which is preferably 25 rpm, engine sync is considered to be complete. At that point, the difference in throttle percentage between the master and slave engines is determined. This value is maintained in the offset table in throttle increments of preferably 5%. Preferably, the offset table is maintained dynamically. That is, every time the operator varies the throttle of the master engine while in sync mode, the ECUs calculate the offset that would be required to fine tune the slave's throttle to mach that of the master.

Whenever the operator varies throttle while in sync mode, the master ECU communicates the current percent of throttle to the slave ECU. The slave ECU then retrieves the corresponding percent of throttle offset from the offset table, and commands the slave throttle actuator to move the throttle actuator rod into the position corresponding to the percent of throttle value, plus the offset read from the table. Then, the ECUs compare current tachometric data from both engines, and continue to adjust the throttles until the master and slave engines are within the predefined tolerance of each other. Thus, as a result of adding the offset before tachometric tuning, the slave engine can more quickly be brought into synchronization with the master engine.

To exit sync mode and return the system to individual control, the operator enters a second sync command at the control station. In response, the sync status indicator provides an indication that the system is now ready to exit sync mode. For example, the LED flashes. To exit sync mode, the operator matches the control levers. In response, the system is no longer in sync mode, and the sync status indicator provides an indication that the system is no longer in sync mode. For example, the LED is turned off and remains unlit. After the system is removed from sync mode, each control lever will control its respective engine.

Preferably, the operator can activate split range throttle and programmable idle while in power train sync mode. Preferably, if either the split range throttle or programmable idle capability is activated while the system is in sync mode, the capability will remain activated even after the system exits sync mode. However, if either the split range throttle or programmable idle capability is activated while the system is not in sync mode, the system cannot be placed into sync mode.

In an alternate embodiment of the invention, power train synchronization can be achieved through "lever synchronization" alone. That is, when the system is placed into power train sync mode, the master lever then communicates its position to the ECU associated therewith (i.e., the master ECU). The master ECU communicates the position of the master lever to the slave ECU via the communications link. Both ECUs then command their associated actuators to position the corresponding actuator rods into the appropriate positions.

The master ECU commands its associated actuators to set their actuator rods to the positions corresponding to the position of the master control lever. The master ECU also communicates this position data to the slave ECU via the communications link.

Each ECU includes a memory that contains a flag that indicates whether the ECU is the master ECU or a slave ECU. Each ECU also includes a memory that contains a flag that indicates whether the system is in sync mode. If the system is in sync mode, the slave ECU ignores the position data it receives from its corresponding control lever, and sets its corresponding actuator rods using the position data it receives from the master ECU. If the system is not in sync mode, the slave ECU sets its corresponding actuator rods using the position data it receives from its corresponding control lever.

In still another embodiment of the invention, power train synchronization can be achieved through "engine synchronization." In this embodiment, the slave engine is controlled not by the position of the master lever, but by monitoring the current throttle rate of the master engine. That is, the master engine communicates the current position of the throttle actuator rod to the master ECU. Preferably, the current position of the throttle actuator rod is communicated as a percentage of its full range of movement. In turn, the master ECU communicates the current position of the throttle actuator rod to the slave ECU. If the system is in sync mode, the slave ECU ignores the lever position data that it receives from the associated control lever, and commands the throttle actuator associated with the slave engine to set the corresponding throttle actuator rod to the position corresponding to the position data that it receives from the master engine.

Figure 8F:
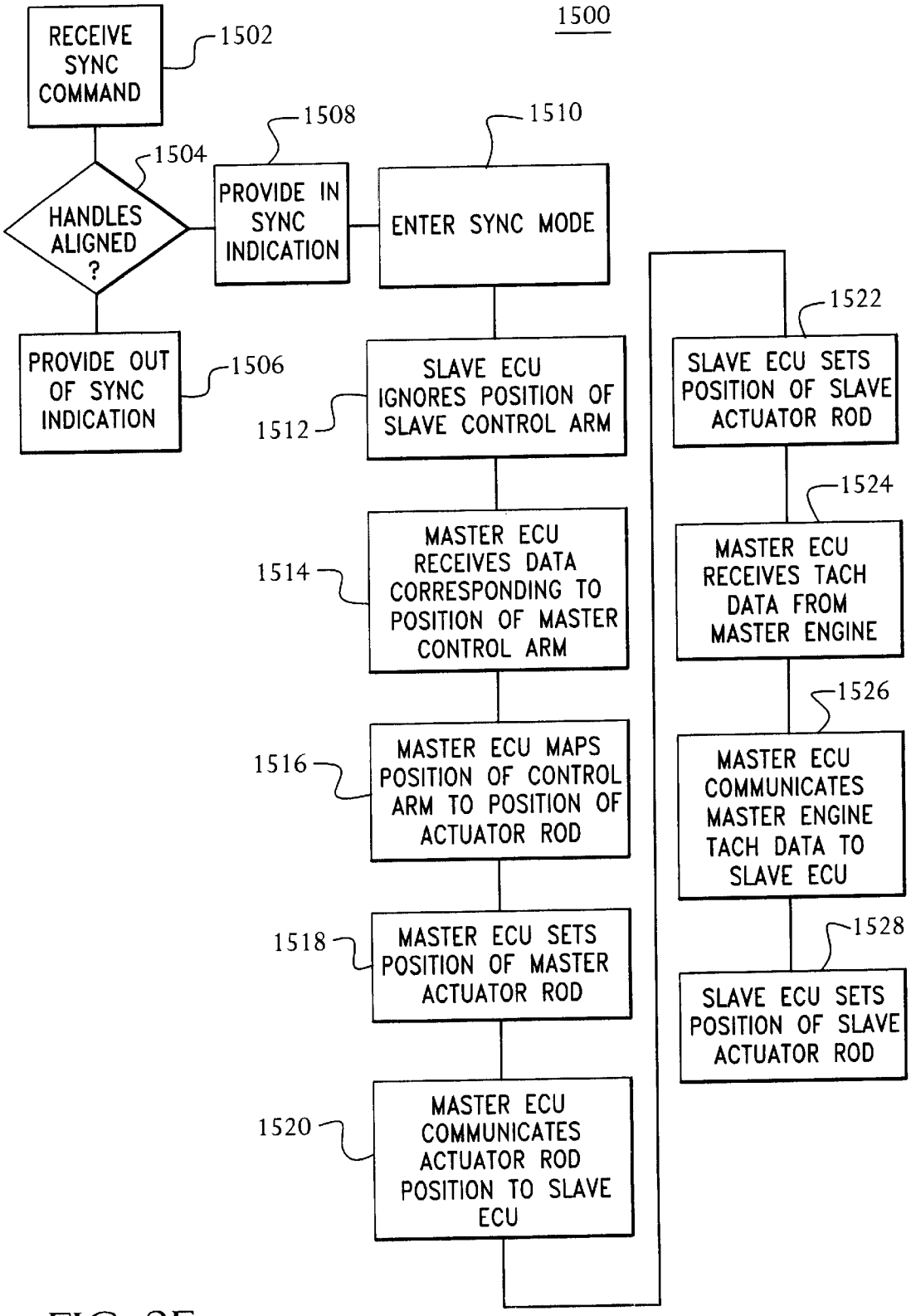

FIG. 8F is a flowchart of a power train sync algorithm 1500 according to the invention. If, at step 1502, the ECU receives a sync command, the ECU determines, at step 1504, whether the control handles are aligned. If, at step 1504, the ECU determines that the control handles are not within a predefined tolerance of each other, the ECU, at step 1506, provides an out-of-sync indication at the control head. If, at step 1504, the ECU determines that the control handles are within the predefined tolerance of each other, the ECU, at step 1508, provides an in-sync indication at the control head and enters sync mode at step 1510.

In sync mode, the slave ECU, at step 1512, ignores the position data it receives from the slave control lever. By contrast, the master ECU receives position data from the master control arm at step 1514, and uses the received position data, at step 1516, to determine how much power to apply to move the master actuator rod into position. At step 1518, the master ECU positions the master actuator rod and, at step 1520, communicates data relating to the master actuator rod's position to the slave ECU via the communications network. At step 1522, the slave ECU positions the slave actuator rod based on the data it receives from the master ECU.

Meanwhile, at step 1524, the master ECU receives tachometric data from the master engine. At step 1526, the master ECU communicates the tach data to the slave ECU. At step 1528, the slave ECU adjusts the position of the slave actuator rod based on the tach data provided by the master ECU.

Dynamic Tuning

It is well known that the amount of force an actuator needs to move its associated actuator rod from a first position to a second position varies from vessel to vessel, and even from engine to engine. Consequently, manufacturers of marine vessels typically calibrate actuator response rate specifically for each installation. Such an approach, however, is usually not acceptable for mass production.

Accordingly, a control system according to the invention can include a dynamic calibration or tuning capability so that the manufacturer and installer need not calibrate the system manually for each installation. Preferably, this capability is implemented as a software algorithm in the ECU's processor.

Whenever the ECU senses that the position of the control arm has changed, it causes the actuator to move its actuator rod into a position corresponding to the position of the control arm. In a preferred embodiment, the ECU causes the actuator rod to move by supplying an electrical current to the actuator's motor. Preferably, the ECU calculates the current needed to drive the actuator's motor using the well known proportional integral derivative (PID) parameters, which provide a standard way to control the actuator servo.

Preferably, the ECU varies the amount of power it provides to the actuator's motor based on historical data it maintains about the amount of power the actuator needs to move its actuator rod a certain distance in a certain amount of time. Preferably, the ECU includes a memory that contains a dynamic tuning table that maps control arm position to power needed to move the actuator rod. Thus, the ECU can determine how far the rod has to be moved (based on the change in control arm position), and index through the table to retrieve an estimate of the power needed to move the rod that far. The ECU then applies that much power to the actuator's motor to move the rod.

The ECU monitors the current position of the actuator rod by receiving a rod position signal from the actuator in much the same way as it monitors the current position of the control arm by receiving an arm position signal from the control head. That is, the actuator includes a position sensing device that sends an electrical signal to the ECU. Preferably, the rod position sensor includes a potentiometer that causes the voltage of the signal to vary with the position of the rod. Thus, the ECU can determine the current position of the actuator rod from the voltage of the electrical signal it receives. Consequently, the ECU can determine the amount of time it takes for the motor to move the rod a certain distance. (The ECU gets timing data from its clock.) It should be understood that a potentiometer is merely an example of a position sensing device and that other position sensors, such as Hall effect feedback sensors, for example, can also be used to sense the position of the actuator rod.

The ECU has a priori knowledge of how long the actuator should be expected to take to move the rod a certain distance. For example, in a preferred embodiment, the actuator is expected to move the rod at a rate of 3 inches/sec. If, over time, the ECU determines that actuator is moving the rod at a rate less than the expected rate, the ECU updates the PID parameters so that, the next time the ECU needs to move the actuator rod, it will apply an appropriate amount of energy. The ECU stores the updated estimate as a new value in the dynamic tuning table. The next time the ECU senses a change in control arm position, it uses the updated value. Preferably, this process is repeated whenever the ECU senses a change in control arm position. Thus, the tuning process is dynamic.

Additionally, while the actuator is moving the rod into place, the dynamic tuning process monitors how quickly the rod is actually moving. If the process determines that more or less force is necessary to move the rod into position in the expected amount of time, then the processor causes the actuator to apply more or less power to achieve the target.

Of course, the ECU has no way of knowing the final position of the control arm until the operator stops moving the arm. To avoid any unnecessary delays that would be caused if the ECU were to wait for the arm to stop moving, the ECU preferably updates the position of the actuator rod more frequently that it receives position data from the control arm. For example, in a preferred embodiment, the ECU receives position data relating to the position of the control arm approximately 10 times per second, while the actuators are updated 50 times per second.

Ideally, the engines should respond to a change in control arm position as soon as the operator begins to move the control handle, and stop varying as soon as the operator stops moving the control handle. In practice, however, it is sufficient to adapt to the positional change within tenths of seconds. It is also well known that the force required to drive an actuator varies depending on whether the actuator is opening or closing the throttle. Thus, according to the invention, the dynamic tuning process can use different drive parameters depending on whether the actuator rod is being extended or retracted. Thus, different sets of PID parameters can be used for extending and retracting the actuator rod.

Preferably, the dynamic tuning process also includes a "watchdog" program that characterizes the rate of change of the actuator. It is well known that the rate at which an actuator can move its control rod changes over time (as system parts wear, etc.). The watchdog program monitors the rate of change of the actuator, and determines whether the rate of change is acceptable. That is, the watchdog program stores historical data relating to the amount of force needed to move the actuator rod a certain distance. The watchdog program can determine from the historical data, the rate at which the actuator is changing. That is, the watchdog program can determine how the amount of force needed to move the rod the same distance changes over time. The watchdog program can then compare this change rate to a predefined change rate, and determine, based on the comparison, whether the rate of change is within acceptable limits. Such a watchdog program can be used to provide the operator with early insight into an actuator or engine that may be failing.

Figure 8G:
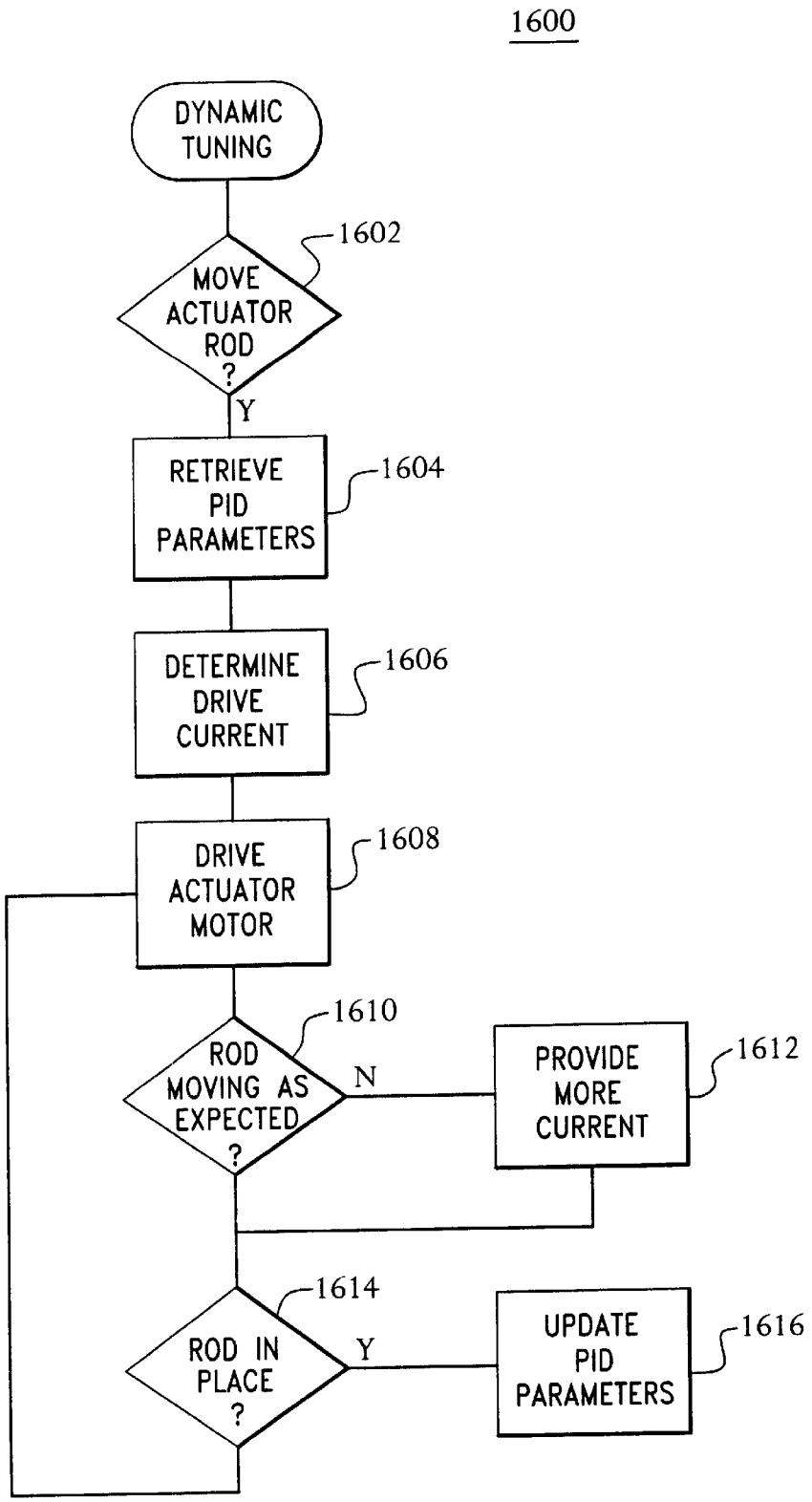

FIG. 8G is a flowchart of a dynamic tuning algorithm 1600 according to the invention. If, at step 1602, the ECU senses that the control arm has moved, the ECU, at step 1604, retrieves the current PID parameters from the dynamic tuning table. At step 1606, the ECU calculates the drive current necessary to drive the actuator's motor to move the rod into a position corresponding to the current position of the control arm.

While the ECU is driving the actuator motor at step 1608, the ECU, at step 1610, monitors the rate at which the rod is moving to determine whether the rod is moving at the expected rate. If, at step 1610, the ECU determines that the rod is moving more slowly than expected, the ECU, at step 1612, supplies more power by increasing the duty cycle of the electrical pulse stream to the actuator's motor. Once the ECU determines, at step 1614, that the rod has moved the required distance, the ECU determines whether the PID parameters need to be changed. If the current had to be increased, the ECU, at step 1616, updates the PID parameters in the dynamic tuning table so that the next time the rod has to be moved, the ECU will apply more power from the start. Consequently, the operator will sense little, if any, change to system response over time.

Thus, there have been described control systems for marine vessels in accordance with the invention. Those skilled in the art will appreciate that numerous changes and modifications may be made to the preferred embodiments of the invention and that such changes and modifications may be made without departing from the spirit of the invention.

For example, it is contemplated that the control systems according to the invention can be used with filly electronic engines. In such an embodiment, the ECU is electrically coupled directly to the engine without the need for an intervening actuator to move the actuator rod. The ECU supplies the engine with the electrical signals needed to vary shift and throttle.

In another contemplated embodiment, the components of the ECU can be integrated into the control head. That is, the control head can include a microcontroller, thereby obviating the need for the electrical connections between the control head and the ECU. In such an embodiment, the communications link couples the control heads directly to one another, and the tach feedback connection is made directly from the engine to the control head.

In another contemplated embodiment, the ECUs and actuators could be CANBus nodes. In such an embodiment, the ECU is coupled to each of the actuators via a communications link as described above. The ECU causes the actuator to move the actuator rods by sending a message via the communications link to the actuator indicating where to set the rod.

It is therefore intended that the appended claims cover all such equivalent variations as fall within the true spirit and scope of the invention.

We claim:

1. A control system for a marine vessel having a first engine, a first transmission associated with the first engine, a second engine, and a second transmission associated with the second engine, the control system comprising:

a control arm having an operating range;

a first electronic control unit (ECU), electrically coupled to the arm position means and coupled to a communications link, comprising:

first control means for controlling a throttle of the first engine and a shift position of the first transmission based on a position of the control arm within its operating range, and first output means for providing a control signal that represents the position of the control arm within its operating range; and a second ECU, coupled to the communications link, comprising:

second input means for receiving the control signal from the first ECU via the communications link, and second control means for controlling the throttle of the second engine and the shift position of the second transmission based on the control signal.

2. A control system for a marine vessel having an engine and a transmission associated with the engine, the control system comprising:

a first control station comprising a first control arm having an operating range and first arm position means coupled to the first control arm for providing a first electrical signal that represents a position of the first control arm within its operating range;

a second control station comprising a plurality of command input devices, a second control arm having an operating range, and second arm position means coupled to the second control arm for providing a second electrical signal that represents a position of the second control arm within its operating range; and an electronic control unit (ECU) comprising:

signal input means, electrically coupled to the first arm position means and the second arm position means, for receiving the first and second electrical signals, command input means, electrically coupled to the command input devices, for receiving a sequence of input command signals from the second control station, and control means for comparing the sequence of input command signals to a predefined input command sequence to identify one of the first and second control station as a master station, and, means for controlling a throttle of the engine and shift position of the transmission based on the electrical signals received from the master station.

3. A control system for a marine vessel having an engine, the control system comprising:

a control arm having an operating range;

arm position means coupled to the control arm for providing an electrical signal that represents a position of the control arm within its operating range;

a memory that contains first and second throttle range values, each said throttle range value corresponding to the operating range of the control arm;

first input means, coupled to the memory, for receiving at least one of the first and second throttle range values;

second input means for receiving a current throttle range indicator that identifies one of the first and second throttle range values as a current throttle range value; and an electronic control unit (ECU) that is electrically coupled to the arm position means comprising:

input means for receiving the electrical signal from the arm position means, and control means for controlling a throttle of the engine based on the electrical signal and the current throttle range value.

4. The control system of claim 1, wherein the operating range of the control arm is up to 160 degrees.

5. The control system of claim 1, wherein the operating range of the control arm includes a first sub-range that corresponds to a forward shift position, a second sub-range that corresponds to a neutral shift position, and a third sub-range that corresponds to a reverse shift position.

6. The control system of claim 1, wherein the communications link is a CANBus.

7. The control system of claim 1, wherein the ECUs pass messages to one another via the communications link using NMEA 2000 protocol.

8. The control system of claim 1, wherein each of the ECUs is electrically connected to a respective corresponding shift actuator and to a respective corresponding throttle actuator.

9. The control system of claim 8, wherein each of the ECUs provides respective actuator drive currents to respective motors in each of the corresponding shift actuators and throttle actuators.

10. The control system of claim 8, wherein each of the shift actuators and throttle actuators includes a respective actuator rod, and wherein actuator rod position feedback signals are carried to the ECU from a rod position sensor in the actuator.

11. The control system of claim 8, wherein each shift actuator is electro-mechanically coupled to a corresponding transmission.

12. The control system of claim 11, wherein each shift actuator actuates the shift position of the corresponding transmission by moving a respective shift actuator rod into one of a number of predefined positions.

13. The control system of claim 8, wherein each throttle actuator is electro-mechanically coupled to a corresponding engine.

14. The control system of claim 13, wherein each throttle actuator actuates the throttle of the corresponding engine by moving a respective throttle actuator rod into one of a number of predefined positions.

15. The control system of claim 1, further comprising:

a control arm position sensor that senses the current position of the control arm within its operating range.

16. The control system of claim 15, wherein the control arm position sensor includes a potentiometer.

17. The control system of claim 1, further comprising:

arm position means coupled to the control arm for providing an electrical signal that represents the position of the control arm within its operating range, wherein the first ECU further comprises:

first input means for receiving the electrical signal, and first control means for controlling the throttle of the first engine and shift position of the first transmission based on the electrical signal.

18. The control system of claim 17, wherein the first ECU determines, from a voltage level of the electrical signal, the current position of the control arm.

19. The control system of claim 18, wherein the first ECU causes shift and throttle actuator rods to be set based on the current position of the control arm.

20. The control system of claim 19, wherein the first ECU further comprises a first ECU memory that contains a conversion table from which the first ECU can determine respective positions to which the shift and throttle actuator rods should be set.

21. The control system of claim 18, wherein the operating range of the control arm is divided into a number of discrete sub-ranges.

22. The control system of claim 21, wherein the operating range of the control arm is divided into 1024 discrete sub-ranges.

23. The control system of claim 21, wherein each discrete sub-range corresponds to a voltage of the electrical signal.

24. The control system of claim 1, wherein at least one of the first and second ECUs comprises an ECU memory having a offset table stored therein, the offset table including predefined data indicating a difference between a percent throttle of the first and second engines when the first and second engines are operating within a predefined range of speeds, and the second control means is adapted to control the throttle of the second engine based at least in part on the predefined data.

25. The control system of claim 24, wherein at least one of the first and second ECUs is adapted to compare a difference between an actual percent throttle of the first and second engines when the first and second engines are operating within the predefined range of speeds and to update the predefined data based differences between the predefined data and the actual percent throttle.

26. The control system of claim 2, wherein the ECU is adapted to transfer control of the engine and the transmission from one of the first and second control stations to the other of the first and second control stations only if the sequence of input command signals matches the predefined input command sequence.

27. The control system of claim 2, wherein the ECU is adapted to transfer control of the engine and the transmission from one of the first and second control stations to the other of the first and second control stations only if the sequence of input command signals matches the predefined input command sequence and the sequence of input command signals is input to the command input devices within a predetermined time interval.

28. The control system of claim 2, wherein the ECU is adapted to transfer control of the engine and the transmission from one of the first and second control stations to the other of the first and second control stations only if the sequence of input command signals matches the predefined input command sequence and the respective positions of the first and second control arm match to within a predetermined tolerance.

29. The control system of claim 28, wherein the ECU is adapted to transfer control of the engine and the transmission from one of the first and second control stations to the other of the first and second control stations only if the sequence of input command signals matches the predefined input command sequence and the respective positions of the first and second control match to within a predetermined tolerance within a predetermined time interval after the sequence of command signals is input to the command input devices.

30. The control system of claim 28, wherein the predetermined tolerance is approximately ten percent.

31. The control system of claim 29, wherein the predetermined time interval is approximately five seconds.

32. The control system of claim 2, wherein the predefined input command sequence is a first select command, a second select command, a neutral command, and a third select command.

33. The control system of claim 3, wherein the first throttle range value is a full throttle range value and the second throttle range value is approximately forty percent of the full throttle range value.

34. The control system of claim 3, wherein the ECU comprises an ECU memory having a first and a second table stored therein, the first table comprising predefined data representing a position of the control arm in relation to a corresponding position of an actuator rod of the throttle when the first throttle range value is used as the current throttle range value, and the second table comprising predefined data representing the position of the control arm in relation to a corresponding position of the actuator rod of the throttle when the second throttle range value is used as the current throttle range value.

35. The control system of claim 3, wherein the current throttle range value is switched between the first and second throttle range values by moving the control arm to a gear idle position and inputting a neutral command to the control system via a neutral command input device.

36. The control system of claim 3, wherein the operating range of the control arm is divided into a number of discrete sub-ranges.

37. The control system of claim 36, wherein the operating range of the control arm is divided into 1024 discrete sub-ranges and each sub-range corresponds to an approximately ten rpm difference in engine throttle rate when the first throttle range value is used as the current throttle range value, and each sub-range corresponds to an approximately four rpm difference in engine throttle rate when the second throttle range value is used as the current throttle range value.

38. A control system for a marine vessel having an engine, the control system comprising:

a control arm having an operating range;

arm position means coupled to the control arm for providing an electrical signal that represents a position of the control arm within its operating range; and an electronic control unit (ECU) that is electrically coupled to the arm position means comprising:

input means for receiving the electrical signal from the arm position means;

an ECU memory having a table stored therein, the table comprising data representing a predefined amount of power required to move a throttle actuator for a throttle of the engine at a predefined rate; and control means for controlling the throttle actuator based on the electrical signal and the predefined amount of power, wherein the ECU is adapted to monitor an actual amount of power required move the actuator at the predefined rate, and to update the data to account for differences between the actual amount of power and the predefined amount of power.

39. A control system for a marine vessel having an engine, the control system comprising:

a control arm having an operating range;

arm position means coupled to the control arm for providing an electrical signal that represents a position of the control arm within its operating range; and an electronic control unit that is electrically coupled to the arm position means comprising:

input means for receiving the electrical signal from the arm position means; and means for controlling a throttle and a transmission of the engine based on the electrical signal, for causing an actuator of the transmission to place the transmission in neutral when power is applied to the control system, and for causing the transmission to remain in neutral until the control arm is moved to a neutral position.

40. The control system of claim 39, wherein the means for controlling the throttle and the transmission is adapted to selectively cause the transmission to remain in neutral when the control arm is moved.

* * * * *